US011185909B2

(12) United States Patent
Ross et al.

(10) Patent No.: US 11,185,909 B2
(45) Date of Patent: Nov. 30, 2021

(54) SYSTEM AND METHOD OF FORMING A METALLIC CLOSURE FOR A THREADED CONTAINER

(71) Applicant: BALL CORPORATION, Broomfield, CO (US)

(72) Inventors: John R. Ross, Broomfield, CO (US); David J. Bonfoey, Broomfield, CO (US)

(73) Assignee: BALL CORPORATION, Westminster, CO (US)

( * ) Notice: Subject to any disclaimer, the term of this patent is extended or adjusted under 35 U.S.C. 154(b) by 170 days.

(21) Appl. No.: 16/131,569

(22) Filed: Sep. 14, 2018

(65) Prior Publication Data

US 2019/0084031 A1 Mar. 21, 2019

Related U.S. Application Data

(60) Provisional application No. 62/559,347, filed on Sep. 15, 2017.

(51) Int. Cl.
*B21D 51/50* (2006.01)
*B21H 7/18* (2006.01)

(52) U.S. Cl.
CPC ..... *B21D 51/50* (2013.01); *B21H 7/187* (2013.01)

(58) Field of Classification Search
CPC ..... B21D 51/50; B21D 51/46; B21D 51/44; B21D 51/48

(Continued)

(56) References Cited

U.S. PATENT DOCUMENTS 2,018,022 A 3/1933 Johnson
2,038,524 A 4/1936 Carvalho (Continued)

FOREIGN PATENT DOCUMENTS

CA 707608 4/1965
CA 720701 11/1965

(Continued)

OTHER PUBLICATIONS

"Ball Packaging Europe at drinktec 2013," Packaging Europe News Oct. 7, 2013, 2 pages [retrieved from: http://www.packagingeurope.com/Packaging-Europe-News/54154/Ball-Packaging-Europe-at-drinktec-2013.html].

(Continued)

*Primary Examiner* — Adam J Eiseman
*Assistant Examiner* — Mohammed S. Alawadi
(74) *Attorney, Agent, or Firm* — Sheridan Ross P.C.

(57) ABSTRACT

An apparatus and methods of forming a metallic closure for a metallic bottle are provided. The present disclosure provides a pre-formed metallic closure and apparatus and methods of forming the metallic closure. The metallic closure can be reformed with a peripheral channel before the metallic closure is positioned on a metallic bottle. An inner tool and an outer tool can form the channel in one operation. Optionally, a thread can be formed on a metallic closure prior to use of the metallic closure to seal a metallic bottle. A capping apparatus of the present disclosure uses less force to seal a metallic bottle with a metallic closure of the present disclosure compared to the force required with a prior art ROPP closure. Accordingly, a metallic closure of the present disclosure can seal a metallic bottle formed of less material (such as by being thinner) than prior art metallic bottles.

20 Claims, 20 Drawing Sheets

(58) Field of Classification Search
USPC ..... 413/8, 23, 24, 27, 31, 2, 4, 6
See application file for complete search history.

(56) References Cited

U.S. PATENT DOCUMENTS 2,091,295 A * 8/1937 Williams ..... B21D 51/44 220/293
2,094,031 A * 9/1937 Williams ..... B21D 51/44 72/345
2,116,199 A 5/1938 Held
2,119,662 A * 6/1938 Williams ..... B21D 51/50 413/23
2,154,409 A * 4/1939 Podel ..... B67B 3/14 53/488
2,207,564 A 7/1940 Wackman
2,215,845 A * 9/1940 Williams ..... B21D 51/50 72/91
2,348,464 A * 5/1944 Bernard ..... B21D 51/50 72/353.4
2,349,037 A 5/1944 Gibbs
2,442,965 A * 6/1948 Thomas ..... B21D 51/50 264/299
2,585,047 A * 2/1952 Scibelli ..... B21D 51/44 72/336
3,029,507 A 4/1962 Gaggini
3,144,964 A 8/1964 Goff et al.
3,147,721 A * 9/1964 Holmes ..... B21D 51/44 72/348
3,164,287 A 1/1965 Williamson
3,227,318 A 1/1966 Rieder
3,232,260 A 2/1966 Siemonsen
3,537,291 A * 11/1970 Hawkins ..... B21D 22/22 72/336
3,578,223 A 5/1971 Armour
3,603,472 A 9/1971 Lecinski, Jr. et al.
3,812,646 A 5/1974 Baldyga et al.
3,824,941 A * 7/1974 Hannon ..... B21D 51/50 413/10
3,866,463 A 2/1975 Smith et al.
3,878,667 A 4/1975 Holstein
4,031,836 A * 6/1977 Grise ..... B21D 51/383 413/67
4,054,229 A 10/1977 Arfert
4,185,576 A 1/1980 George
4,199,073 A * 4/1980 Gombas ..... B21D 51/44 220/623
4,232,500 A 11/1980 Holstein
4,243,438 A 1/1981 Yanagida et al.
4,260,419 A 4/1981 Robertson
4,282,044 A 8/1981 Robertson et al.
4,318,755 A 3/1982 Jeffrey et al.
4,392,580 A * 7/1983 Ochs ..... B21D 51/44 215/332
4,403,493 A 9/1983 Atkinson
4,411,707 A 10/1983 Brennecke et al.
4,420,959 A * 12/1983 King ..... B21D 51/50 413/23
4,466,548 A * 8/1984 Herbert ..... B65D 51/1688 215/307
4,561,280 A * 12/1985 Bachmann ..... B21D 51/44 72/346
4,693,108 A 9/1987 Traczyk et al.
4,732,027 A 3/1988 Traczyk et al.
4,823,537 A * 4/1989 Duke ..... B21D 51/50 215/252
4,895,012 A * 1/1990 Cook ..... B21D 51/44 72/361
5,078,290 A 1/1992 Ochs
5,102,705 A 4/1992 Yammoto et al.
5,104,465 A 4/1992 McAuliffe et al.
5,110,545 A 5/1992 McAuliffe et al.
5,138,858 A * 8/1992 Johnson ..... B21D 51/2615 72/379.4
5,174,145 A 12/1992 Tsuzuki
5,207,341 A 5/1993 Yeager
5,255,805 A 10/1993 Weiss et al.
5,293,765 A 3/1994 Nussbaum-Pogacnik
5,355,710 A 10/1994 Diekhoff
5,362,341 A 11/1994 Palmer et al.
5,394,727 A 3/1995 Diekhoff et al.
5,445,284 A 8/1995 Guest
5,448,903 A 9/1995 Johnson
5,469,729 A 11/1995 Hager
5,486,243 A 1/1996 Hashiguchi et al.
5,487,295 A 1/1996 Diekhoff et al.
5,503,690 A 4/1996 Wade et al.
5,522,248 A 6/1996 Diekhoff et al.
5,522,950 A 6/1996 Bartges et al.
5,551,997 A 9/1996 Marder et al.
5,571,347 A 11/1996 Bergsma
5,572,893 A 11/1996 Goda et al.
5,704,240 A 1/1998 Jordan
5,713,235 A 2/1998 Diekhoff
5,718,352 A 2/1998 Diekhoff et al.
5,769,331 A 6/1998 Yamagishi et al.
5,772,802 A 6/1998 Sun et al.
5,778,723 A 7/1998 Silverman et al.
5,806,707 A 9/1998 Boehm et al.
5,822,843 A 10/1998 Diekhoff et al.
6,010,026 A 1/2000 Diekhoff et al.
6,010,028 A 1/2000 Jordan et al.
6,100,028 A 8/2000 Cole et al.
6,126,034 A 10/2000 Borden et al.
6,171,362 B1 1/2001 Osumi et al.
6,301,766 B1 10/2001 Kollé
6,341,706 B1 1/2002 Neuner
6,355,090 B1 3/2002 Ohyama et al.
6,368,427 B1 4/2002 Sigworth
6,375,020 B1 4/2002 Marquez
6,543,636 B1 4/2003 Flecheux et al.
6,588,614 B2 7/2003 Neuner
6,607,615 B1 8/2003 Bekki et al.
6,626,310 B2 9/2003 Taha
6,627,012 B1 9/2003 Tack et al.
6,630,037 B1 10/2003 Sawada et al.
6,666,933 B2 12/2003 Roberts et al.
6,676,775 B2 1/2004 Barth et al.
6,713,235 B1 3/2004 Ide et al.
6,766,677 B1 * 7/2004 Turnbull ..... B21D 51/44 72/348
6,779,677 B2 8/2004 Chupak
6,907,653 B2 6/2005 Chupak
6,945,085 B1 9/2005 Goda
6,959,830 B1 11/2005 Kanou et al.
7,117,704 B2 10/2006 Ogura et al.
7,140,223 B2 11/2006 Chupak
7,147,123 B2 12/2006 Yamashita
7,171,840 B2 2/2007 Kanou et al.
7,294,213 B2 11/2007 Warner et al.
7,503,741 B2 3/2009 Gillest
7,520,044 B2 4/2009 Bulliard et al.
7,555,927 B2 7/2009 Hanafusa et al.
7,588,808 B2 9/2009 Hutchinson et al.
7,666,267 B2 2/2010 Benedictus et al.
7,713,363 B2 5/2010 Sano et al.
7,798,357 B2 9/2010 Hanafusa et al.
7,824,750 B2 11/2010 Takegoshi et al.
7,905,130 B2 3/2011 Marshall et al.
7,942,028 B2 5/2011 Gillest et al.
7,946,436 B2 5/2011 Laveault et al.
8,016,148 B2 9/2011 Walsh
8,037,728 B2 10/2011 Hosoi
8,037,734 B2 10/2011 Hanafusa et al.
8,091,402 B2 1/2012 Hanafusa et al.
8,132,439 B2 3/2012 Hanafusa et al.
8,132,687 B2 3/2012 Fedusa et al.
8,313,003 B2 11/2012 Riley et al.
8,349,419 B2 1/2013 Nishida et al.
8,360,266 B2 1/2013 Adams et al.
8,474,634 B1 7/2013 Branson et al.
8,496,131 B2 7/2013 Forrest et al.
8,505,350 B2 8/2013 Marshall et al.
8,631,632 B2 1/2014 Morales et al.

(56) References Cited

U.S. PATENT DOCUMENTS

| | | | | |
|---|---|---|---|---|
| 8,740,001 | B2 | 6/2014 | Hanafusa et al. | |
| 9,227,748 | B2 | 1/2016 | Nakagawa et al. | |
| 9,327,899 | B2 | 5/2016 | Greenfield et al. | |
| 9,409,433 | B2 | 8/2016 | Carreras | |
| 9,517,498 | B2 | 12/2016 | Siles et al. | |
| 9,663,846 | B2 | 5/2017 | Siles et al. | |
| 9,821,926 | B2 | 11/2017 | Robinson et al. | |
| 9,844,805 | B2 | 12/2017 | Siles et al. | |
| 2001/0003292 | A1 | 6/2001 | Sun et al. | |
| 2001/0031376 | A1 | 10/2001 | Fulton et al. | |
| 2002/0134747 | A1 | 9/2002 | Babcock et al. | |
| 2003/0102278 | A1 | 6/2003 | Chupak | |
| 2003/0132188 | A1 | 7/2003 | Beek et al. | |
| 2004/0025981 | A1 | 2/2004 | Tack et al. | |
| 2004/0035871 | A1 | 2/2004 | Chupak | |
| 2004/0140237 | A1 | 7/2004 | Brownewell | |
| 2004/0173560 | A1 | 9/2004 | Chupak | |
| 2004/0213695 | A1 | 10/2004 | Ferreira et al. | |
| 2005/0029219 | A1 | 2/2005 | Taber et al. | |
| 2005/0115294 | A1 | 6/2005 | Kanou et al. | |
| 2005/0127077 | A1 | 6/2005 | Chupak | |
| 2006/0169665 | A1 | 8/2006 | Matukawa et al. | |
| 2007/0034593 | A1 | 2/2007 | Ichimura et al. | |
| 2007/0051687 | A1 | 3/2007 | Olson | |
| 2007/0062952 | A1 | 3/2007 | Kobayashi et al. | |
| 2007/0080128 | A1 | 4/2007 | Laveault et al. | |
| 2007/0175855 | A1 | 8/2007 | Penny | |
| 2007/0295051 | A1 | 12/2007 | Myers et al. | |
| 2008/0022746 | A1 | 1/2008 | Myers et al. | |
| 2008/0041501 | A1 | 2/2008 | Platek et al. | |
| 2008/0047922 | A1 | 2/2008 | Olson et al. | |
| 2008/0073309 | A1 | 3/2008 | Nakajima et al. | |
| 2008/0163663 | A1 | 7/2008 | Hankey et al. | |
| 2008/0181812 | A1 | 7/2008 | Ferreira et al. | |
| 2008/0299001 | A1 | 12/2008 | Langlais et al. | |
| 2009/0178995 | A1 | 7/2009 | Tung et al. | |
| 2009/0220714 | A1 | 9/2009 | Nishida et al. | |
| 2009/0277862 | A1 | 11/2009 | Masuda et al. | |
| 2010/0065528 | A1 | 3/2010 | Hanafusa et al. | |
| 2010/0199741 | A1 | 8/2010 | Myers et al. | |
| 2011/0113732 | A1 | 5/2011 | Adams et al. | |
| 2011/0114649 | A1 | 5/2011 | Adams et al. | |
| 2012/0024813 | A1 | 2/2012 | Nakagawa et al. | |
| 2012/0031913 | A1 | 2/2012 | Moore et al. | |
| 2012/0269602 | A1 | 10/2012 | Hanafusa et al. | |
| 2013/0199017 | A1 | 8/2013 | Kurosawa et al. | |
| 2013/0202477 | A1 | 8/2013 | Zajac et al. | |
| 2013/0313287 | A1 | 11/2013 | Walsh et al. | |
| 2014/0021157 | A1 | 1/2014 | Gren et al. | |
| 2015/0013416 | A1 | 1/2015 | Hosoi | |
| 2015/0020364 | A1 | 1/2015 | Bonfoey | |
| 2015/0135508 | A1 | 5/2015 | Ichimura et al. | |
| 2015/0165509 | A1* | 6/2015 | Dunwoody | B21D 19/12 72/362 |
| 2015/0225107 | A1 | 8/2015 | Ross et al. | |
| 2015/0343516 | A1 | 12/2015 | Schremmer et al. | |
| 2015/0344166 | A1 | 12/2015 | Davis et al. | |
| 2015/0375888 | A1 | 12/2015 | Hosoi | |
| 2016/0052678 | A1 | 2/2016 | Hanafusa et al. | |
| 2016/0340088 | A1 | 11/2016 | Olson et al. | |
| 2017/0267415 | A1 | 9/2017 | Olson et al. | |
| 2017/0320637 | A1 | 11/2017 | Jones et al. | |
| 2018/0044155 | A1 | 2/2018 | Ross et al. | |
| 2018/0229900 | A1 | 8/2018 | Ross et al. | |
| 2019/0084728 | A1 | 3/2019 | Bonfoey et al. | |

FOREIGN PATENT DOCUMENTS

| | | |
|---|---|---|
| CA | 1252649 | 4/1989 |
| CA | 2133312 | 7/1994 |
| CA | 2169743 | 2/1995 |
| CA | 2206483 | 9/1999 |
| CA | 2302557 | 9/2001 |
| CA | 2469238 | 6/2003 |
| CA | 2655925 | 1/2008 |
| CA | 2662199 | 3/2008 |
| CA | 2665477 | 5/2008 |
| CA | 2638403 | 10/2009 |
| CN | 1044925 | 8/1990 |
| CN | 1256671 | 6/2000 |
| CN | 1994826 | 7/2007 |
| CN | 101294255 | 10/2008 |
| CN | 100515875 | 7/2009 |
| CN | 101888907 | 11/2010 |
| CN | 101985707 | 3/2011 |
| DE | 6903478 | 5/1969 |
| DE | 2314662 | 10/1973 |
| DE | 3927491 | 2/1991 |
| DE | 4315111 | 11/1994 |
| DE | 60206036 | 6/2006 |
| DE | 102005010786 | 2/2007 |
| EP | 0721384 | 7/1996 |
| EP | 0740971 | 11/1996 |
| EP | 1136154 | 9/2001 |
| EP | 1531952 | 8/2006 |
| EP | 1731239 | 12/2006 |
| EP | 2119515 | 11/2009 |
| EP | 2146907 | 1/2010 |
| EP | 2531409 | 12/2012 |
| EP | 2646328 | 10/2013 |
| EP | 2662295 | 11/2013 |
| EP | 2662296 | 11/2013 |
| EP | 2835188 | 2/2015 |
| EP | 2955131 | 12/2015 |
| FR | 1371041 | 8/1964 |
| FR | 2775206 | 8/1999 |
| GB | 449861 | 7/1936 |
| GB | 971258 | 9/1964 |
| GB | 1215648 | 12/1970 |
| GB | 1598428 | 9/1981 |
| HU | 229285 | 10/2013 |
| JP | S57-97644 | 6/1982 |
| JP | S58-030947 | 2/1983 |
| JP | S61-163233 | 7/1986 |
| JP | S62-263954 | 11/1987 |
| JP | H07-211494 | 8/1995 |
| JP | H09-057384 | 3/1997 |
| JP | H10-203573 | 8/1998 |
| JP | H11-293363 | 10/1999 |
| JP | 2000-063973 | 2/2000 |
| JP | 2001-115226 | 4/2001 |
| JP | 2001-172728 | 6/2001 |
| JP | 2001-181768 | 7/2001 |
| JP | 2001-213416 | 8/2001 |
| JP | 2001-315745 | 11/2001 |
| JP | 2002-137032 | 5/2002 |
| JP | 2002-173717 | 6/2002 |
| JP | 2002-192272 | 7/2002 |
| JP | 2002-237902 | 8/2002 |
| JP | 2002-302137 | 10/2002 |
| JP | 2003-54687 | 2/2003 |
| JP | 2003-094133 | 4/2003 |
| JP | 3408213 | 5/2003 |
| JP | 2003-192093 | 7/2003 |
| JP | 2003-205924 | 7/2003 |
| JP | 2003-268460 | 9/2003 |
| JP | 2003-320432 | 11/2003 |
| JP | 2003-334631 | 11/2003 |
| JP | 2004-035036 | 2/2004 |
| JP | 2004-083128 | 3/2004 |
| JP | 2004-203462 | 7/2004 |
| JP | 2004-210403 | 7/2004 |
| JP | 2004-262488 | 9/2004 |
| JP | 2005-096843 | 4/2005 |
| JP | 2005-511418 | 4/2005 |
| JP | 3665002 | 4/2005 |
| JP | 2005-132401 | 5/2005 |
| JP | 2005-186164 | 7/2005 |
| JP | 2005-193272 | 7/2005 |
| JP | 2005-263230 | 9/2005 |
| JP | 2005-280768 | 10/2005 |
| JP | 2006-001619 | 1/2006 |
| JP | 2006-62755 | 3/2006 |

(56) References Cited

FOREIGN PATENT DOCUMENTS

| | | |
|---|---|---|
| JP | 2006-62756 | 3/2006 |
| JP | 3754076 | 3/2006 |
| JP | 2006-095694 | 4/2006 |
| JP | 2006-321541 | 11/2006 |
| JP | 2007-015003 | 1/2007 |
| JP | 3886329 | 2/2007 |
| JP | 2007-061881 | 3/2007 |
| JP | 2007-106621 | 4/2007 |
| JP | 2007-153363 | 6/2007 |
| JP | 2008-068320 | 3/2008 |
| JP | 2008-087071 | 4/2008 |
| JP | 4115133 | 4/2008 |
| JP | 4159956 | 7/2008 |
| JP | 4173388 | 8/2008 |
| JP | 4245916 | 1/2009 |
| JP | 2009-40461 | 2/2009 |
| JP | 2009108421 | 5/2009 |
| JP | 2010-018336 | 1/2010 |
| JP | 2010-202908 | 9/2010 |
| JP | 4553350 | 9/2010 |
| JP | 4564328 | 10/2010 |
| JP | 4646164 | 12/2010 |
| JP | 2011-037497 | 2/2011 |
| JP | 4723762 | 4/2011 |
| JP | 2011-116456 | 6/2011 |
| JP | 4757022 | 8/2011 |
| JP | 2011-208273 | 10/2011 |
| JP | 2011-526232 | 10/2011 |
| JP | 2012-192984 | 10/2012 |
| JP | 5290569 | 6/2013 |
| JP | 5323757 | 7/2013 |
| JP | 2013-244996 | 12/2013 |
| JP | 5597333 | 8/2014 |
| JP | 5855233 | 12/2015 |
| JP | 5857038 | 2/2016 |
| JP | 5887340 | 2/2016 |
| RU | 2221891 | 1/2004 |
| SU | 305941 | 6/1971 |
| UA | 44247 | 2/2002 |
| UA | 29644 | 2/2007 |
| UA | 28415 | 12/2007 |
| WO | WO 92/04477 | 3/1992 |
| WO | WO 93/17864 | 9/1993 |
| WO | WO 94/20237 | 9/1994 |
| WO | WO 96/15865 | 5/1996 |
| WO | WO 96/28582 | 9/1996 |
| WO | WO 98/46488 | 10/1998 |
| WO | WO 99/32363 | 7/1999 |
| WO | WO 99/37826 | 7/1999 |
| WO | WO 01/92116 | 12/2001 |
| WO | WO 03/047991 | 6/2003 |
| WO | WO 03/057572 | 7/2003 |
| WO | WO 2004/018121 | 3/2004 |
| WO | WO 2004/094679 | 11/2004 |
| WO | WO 2007/030554 | 3/2007 |
| WO | WO 2008/089291 | 7/2008 |
| WO | WO 2009/091821 | 7/2009 |
| WO | WO 2009/115377 | 9/2009 |
| WO | WO 2010/117009 | 10/2010 |
| WO | WO 2011/059854 | 5/2011 |
| WO | WO 2011/078057 | 6/2011 |
| WO | WO 2011/147578 | 12/2011 |
| WO | WO 2012/133391 | 10/2012 |
| WO | WO 2012/144490 | 10/2012 |
| WO | WO 2013/167478 | 11/2013 |
| WO | WO 2013/167483 | 11/2013 |
| WO | WO 2014/168873 | 10/2014 |
| WO | WO 2015/054284 | 4/2015 |
| WO | WO 2017/134413 | 8/2017 |
| WO | WO 2017/191287 | 11/2017 |

OTHER PUBLICATIONS

"Electromagnetic forming," retrieved from http://en.wikipedia.org/wiki/Electromagnetic_forming, retrieved on Nov. 17, 2014, 4 pages.

"Impact Extrusion," Wikipedia, Dec. 9, 2009 retrieved from https://web.archive.org/web/20091209012819/http://en.wikipedia.org/wiki/Impact_extrusion, 5 pages.

"Screw thread," retrieved from http://en.wikipedia.org/wii/Screw_thread, retrieved on Jan. 8, 2015, 17 pages.

Cui et al. "Recycling of automotive aluminum," Transactions of Nonferrous Metals Society of China, Nov. 2010, vol. 20, No. 11, pp. 2057-2063.

Fisher et al. "Recycling—The Effect On Grain Refinement of Commercial Aluminum Alloys," London & Scandinavian Metallurgical Co Limited, 122nd TMS Annual Meeting & Exhibition, Feb. 21-25, 1993, 6 pages.

Goltz "Aluminum Bottles are Successful," University of Wisconsin, 2005, 5 pages [retrieved from: http://www2.uwstout.edu/content/rs/2005/article6.pdf].

Guley et al. "Direct recycling of 1050 aluminum alloy scrap material mixed with 6060 aluminum alloy chips by hot extrusion," International Journal of Material Forming, Apr. 2010, vol. 3, No. Suppl. 1, pp. 853-856.

Herbert, "Manufacturing Processes," Prentice-Hall, Inc., Englewood Cliffs, NJ, excerpts from pp. 548-553, 562-563, 1979, 11 pages.

Tekkaya et al. "Hot profile extrusion of AA-6060 aluminum chips," Journal of Materials Processing Technology, Apr. 2009, vol. 209, No. 7, pp. 3343-3350.

International Search Report and Written Opinion for International (PCT) Patent Application No. PCT/US2018/051071, dated Nov. 21, 2018 12 pages.

International Preliminary Report on Patentability for International (PCT) Patent Application No. PCT/US2018/051071, dated Mar. 26, 2020 11 pages.

Official Action for Australia Patent Application No. 2018334223, dated Jun. 10, 2021 6 pages.

Official Action for Australian Patent Application No. 2018334223, dated Nov. 20, 2020, 4 pages.

Official Action for Canada Patent Application No. 3,074,430, dated May 3, 2021, 5 pages.

Official Action (with English translation) for Japan Patent Application No. 2020-514732, dated Feb. 16, 2021, 21 pages.

Official Action (with English translation) for Russian Patent Application No. 2020112455, dated Sep. 30, 2020, 12 pages.

Official Action (with English translation) for Russian Patent Application No. 202011245, dated Feb. 20, 2021, 3 pages.

Extended Search Repot for European Patent Application No. 18856151.8, dated May 7, 2021 11 pages.

Official Action (with English translation) for Japan Patent Application No. 2020-514732, dated Aug. 31, 2021, 7 pages.

* cited by examiner

SYSTEM AND METHOD OF FORMING A METALLIC CLOSURE FOR A THREADED CONTAINER

CROSS-REFERENCE TO RELATED APPLICATIONS

This application claims priority under 35 U.S.C. § 119(e) to U.S. Provisional Patent Application Ser. No. 62/559,347 filed Sep. 15, 2017, which is incorporated herein in its entirety by reference.

FIELD

The present disclosure relates generally to the manufacture and sealing of containers. More specifically, this disclosure provides an apparatus and methods to form a threaded metallic closure which can subsequently be used to seal a threaded metallic container such as a bottle.

BACKGROUND

Metallic containers offer distributors and consumers many benefits and are used to store a variety of products including beverages and food products. Some metallic containers for beverages have a bottle shape. Metallic bottles typically include a closed bottom portion, a generally cylindrical body portion, a neck portion with a reduced diameter extending upwardly from the body portion, and an opening positioned on an uppermost portion of the neck portion. After being filled with a beverage or other product, metallic bottles are typically sealed with a roll-on-pilfer proof closure (ROPP), although other closures, such as twist-off crown caps and roll-on closures without a pilfer proof feature, may be used. Methods and apparatus of forming a threaded neck on a metallic bottle to receive a ROPP closure are described in U.S. Patent Application Publication No. 2014/0263150 and U.S. Patent Application Publication No. 2014/0298641, which are each incorporated herein by reference in their entirety.

Referring now to FIGS. 1A-1D, several actions must occur to generate and maintain an effective seal between a metallic bottle 2 and a ROPP closure 10. As shown in FIGS. 1A-1B, a ROPP shell 9 with an unthreaded body portion 12A is placed on the neck portion 4 of the metallic bottle 2. The ROPP shell 9 covers the bottle threads 8. A pilfer band 18 of the ROPP shell 9 extends downward past a skirt 30 of the metallic bottle 2.

Referring now to FIG. 1C, a capping apparatus 22 subsequently performs three operations, including: (1) reforming the top portion 20 of the ROPP closure 10 to form a reform or channel 32; (2) forming threads 16 on a portion of the closure body 12; and (3) tucking the pilfer band 18 against the metallic bottle 2. The timing and sequence of these three actions varies between different prior art capping apparatus 22.

Generally, one or more of a pressure block ejector 24 and a pressure block 25 apply a load, or "top-load," to a top portion 20 of the ROPP closure 10 to press an outer edge of the top portion 20 down around a curl 6 of the metallic bottle 2 creating a reform or channel 32. An interior surface of the channel 32 applies force to a liner 14 within the ROPP closure 10. Accordingly, the liner 14 contacts an exterior of the bottle curl 6 to form an effective seal. Prior art capping apparatus 22 typically apply at least approximately 240 lbs. of top-load to form the channel 32.

Once sealed, closure threads 16 are formed on the ROPP closure 10 by the capping apparatus 22 to maintain the seal once the pressure block ejector 24 and the pressure block 25 are removed. More specifically, all known prior art capping apparatus 22 form threads 16 on the closure body 12 while the ROPP closure is positioned on the bottle neck 4.

The closure threads 16 are formed by a thread roller 26 that applies a "side-load" to the closure body 12. Typically, two thread rollers 26 are used. The thread rollers 26 use the underlying bottle threads 8 as a mandrel. The closure threads 16 are formed as the thread rollers 26 press against and chase down the body portion 12 along the bottle threads 8 from the closure top portion 20 toward the pilfer band 18. Generally, the top-load must be maintained until at least one thread revolution has been formed to absorb slack metal in the ROPP closure 10 and cause the closure seal geometry to plastically deform. Prior art thread rollers 26 typically apply at least approximately 23 pounds of side-load to a metallic bottle 2 when forming the closure threads 16.

Two pilfer rollers 28 tuck the bottom edge of the ROPP closure 10 against a protrusion, known as the skirt 30, of the metallic bottle 2. The pilfer band 18 is typically rolled inwardly at an angle of about 45° on the bottle 2 by the pilfer rollers 28. In this manner, if the ROPP closure 10 is rotated in an opening direction, which is generally counter-clockwise, the pilfer band 18 is severed to provide visual evidence of tampering. The pilfer rollers 28 also apply a side-load to the metallic bottle 2 to tuck the pilfer band 18 against the bottle skirt 30. An example of a neck portion 4 of a metallic bottle 2 sealed by a ROPP closure 10 is illustrated in FIG. 1D.

Referring now to FIGS. 1E-1F, portions of the liner 14 between the closure channel 32 of the ROPP closure 10 and the bottle curl 6 are generally illustrated. The liner 14 is illustrated in contact with the curl 6 to seal the metallic bottle 2.

Referring now to FIG. 2, side-load 34 and top-load 36 forces applied by a prior art capping apparatus 22 are provided in a graphical format. The upper line identifies side-load 34 forces applied by the thread rollers 26 and the pilfer roller 28. The lower line 36 identifies top-load force applied during ROPP closure application and reform of the ROPP closure 10 to form the channel 32. The reform top-load 36 and thread/pilfer formation side-load 34 are applied by separate cams of the capping apparatus 22 simultaneously. More specifically, the side-load 34 and top-load 36 forces begin and end at approximately identical times. Both the top-load 36 and side-load 34 forces are constant during the ROPP closure 10 application process. The side-load 34 is momentarily reduced approximately half-way through the capping process proximate to point 35 to allow the thread rollers 26 to spring back to an initial position proximate to the curl 6 so that the closure threads 16 may be formed a second time.

Referring now to FIG. 3, a graph of side-load 38 and top-load 40 forces applied by another prior art capping apparatus 22 is provided. The application of the top-load 40 applied to the metallic bottle 2 by the pressure block ejector 24 and the pressure block 25 is used to actuate spring loaded roller arms associated with the thread rollers 26 and the pilfer rollers 28. The two actions are driven by a single cam and are not separable. Accordingly, the side-load 38 and top-load 40 forces begin and end at approximately identical times. Due to the shape of the cam, the top-load 40 initially spikes proximate to point 41 as the pressure block ejector 24 and the pressure block 25 engage and apply the top-load to the top portion 20 of the ROPP closure 10. The spike (point 41) of the top-load 40 is approximately 15% of the total top-load 40. The side-load 38 and the top-load 40 are both interrupted about half-way through the closure application process proximate to point 39 to allow the thread rollers 26 to spring back to their initial position proximate to the curl 6 so that the closure threads 16 may be formed a second time.

Glass bottles sealed with ROPP closures using a similar capping apparatus typically receive a cumulative load of at least 500 pounds. In contrast, the top-load applied by the pressure block ejector 24 and pressure block 25 and the side-loads applied by the rollers 26, 28 to seal metallic bottles 2 formed of aluminum are reduced compared to the forces used to seal glass bottles. For example, prior art capping apparatus 22 used to seal metallic bottles 2 formed of aluminum with ROPP closures 10 generally reduce the cumulative load to approximately 360 pounds and reduce the load range to +/−5% lbs. since the aluminum bottles are more prone to deformation or collapse.

Failures are possible when a greater than nominal top-load is used with a nominal side-load. For example, when too much force is applied by a capping apparatus 22 during sealing of a metallic bottle 2 with a ROPP closure 10, one or more of the bottle threads 8 and the skirt portion 30 of the metallic bottle 2 may collapse or otherwise deform. Another failure observed when too much top-load is used is deformation of the metallic bottle 2. For example, a cross-sectional shape of the neck portion 4 of the metallic bottle 2 may be deformed from a preferred generally circular shape to a non-circular shape such as an oval or an ellipse. Still another failure associated with the use of too much top-load is ROPP closures 10 that are undesirably difficult to remove from metallic bottles 2.

Failures also occur when less than the nominal top-load is used with a nominal side-load to seal a metallic bottle 2. A less than nominal top-load may result in a failure due to substandard sealing of the metallic bottle 2. For example, when a less than nominal top-load is used, the closure channel 32 may have an inconsistent shape or an inadequate depth. This can result in insufficient contact of the ROPP liner 14 with the bottle curl 6 and a failure to seal the metallic bottle 2. Another failure caused by using too little top-load is loss of seal of the metallic bottle 2 by movement of the ROPP closure 10. This can result in venting of the content of the metallic bottle 2.

Referring now to FIG. 4, current production capping loads generated by a prior art capping apparatus 22 are plotted to illustrate a cumulative load failure region 42 above a failure threshold 44 line. The combined side-load force generated by two thread rollers 26 and two pilfer rollers 28 is plotted on the X-axis in pounds. The top-load force generated by the pressure block ejector 24 and the pressure block 25 are plotted on the Y-axis in pounds. A nominal load 46 for a known capping apparatus 22 includes a top-load force of approximately 270 pounds from the pressure block ejector 24 and pressure block 25 and a side-load force of approximately 86 pounds (comprising side-load forces applied by each of two thread rollers 26 and by each of the two pilfer rollers 28). One prior art capping apparatus nominally applies a cumulative load 46 of approximately 360 lbs. to a metallic bottle when the metallic bottle is sealed with a ROPP closure. Although less than the cumulative load applied to glass bottles sealed with ROPP closures, these loads are almost excessive for current metallic bottles 2. Further, the cumulative load 46 provides less than approximately 30 pounds of margin 47 before the failure threshold 44 is reached. Accordingly, there is only a small production window that is useful for capping known metallic bottles 2 with prior art capping apparatus 22 and methods. The small production window results in overstress and failures of the metallic bottle 2 or the ROPP closure 10 when the capping apparatus 22 is out of calibration or for marginal metallic bottles 2. Further, because the cumulative load 46 applied by the prior art processes and capping apparatus 22 are close to the maximum amount 44 that the metallic bottle 2 can withstand, it is not possible produce a light-weight metallic bottle that can be sealed with a ROPP closure 10 using the prior art processes and capping apparatus 22. Further, deeper threads, which require more sideload, cannot be formed on the ROPP closure 10.

Another problem with prior art ROPP closures used to seal metallic containers is that a ROPP closure 10 may not be concentrically aligned with a metallic bottle 2 when a capping apparatus 22 forms a closure channel 32. Referring again to FIGS. 1A-1B, to position a prior art ROPP shell 9 on the bottle neck 4, an interior diameter of the ROPP shell 9 must be greater than the exterior diameter of the bottle threads 8 and the bottle skirt 30 such that the ROPP shell 9 can be loaded onto the metallic bottle 2 at higher production speeds. Accordingly, there is a gap 13 between an interior surface of the ROPP shell 9 and an exterior surface of the threads 8 and bottle skirt 30 as shown in FIG. 1B. When the pressure block 25 of the capping apparatus 22 forms the closure channel 32, the ROPP closure 10 may be off-center or tilted due to the gap 13. As a result, the closure channel 32 may be asymmetric or have a variable depth.

More specifically, and referring now to FIG. 5, a metallic bottle 2 sealed with a ROPP closure 10 by a prior art capping apparatus 22 is shown. The closure channel 32 has a variable depth and is asymmetric. For example, on the left side of FIG. 5, the closure channel portion 32A has a depth 33A that is less than a depth 33B of the closure channel portion 32B on the right side of FIG. 5.

A further problem visible with the ROPP closure 10 shown in FIG. 5 is that the pilfer band portion 18A extends over the bottle skirt 30 (which is illustrated in FIG. 1D) less than the pilfer band portion 18B. More specifically, the lowermost portion of the pilfer band 18 is not parallel to a diameter 5 of the bottle neck 4 such that pilfer band portion 18A is further from the diameter 5 than pilfer band portion 18B. The pilfer band portion 18B also includes a flared portion 19 that is not pressed against the bottle neck 4. This can result in a cutting hazard for a consumer. Additionally, a lowermost portion of the pilfer band 18 is uneven and has a "wavy" appearance.

The improper formation of the pilfer band 18 and the closure channel 32 may have been caused because a longitudinal axis 11 of the ROPP closure 10 was not co-linear with a longitudinal axis 3 of the metallic bottle 2 when the capping apparatus 22 formed the closure channel 32 on the ROPP closure 10. For example, the ROPP closure may have been tilted such that the closure axis 11 was not parallel to the bottle axis 3. Regardless, the gap 13 (illustrated in FIG. 1B) between the interior surface of the ROPP closure and the exterior of the bottle threads and skirt allows unintended movement of the closure 10 with respect to the bottle 2 when the capping apparatus 22 forms the closure channel 32.

The asymmetric channel 32A, 32B can cause a loss of seal between the ROPP closure 10 and the metallic bottle and spoilage of a product stored in the metallic bottle 2. Additional spoilage may result due to the improperly formed pilfer band 18A, 18B. More specifically, some production inspection systems cannot differentiate between a defective tamper band 18A, 18B which is wavy (but a non-critical defect) and a broken bridge of the pilfer band which is a critical defect. Accordingly, an inspection system would reject the metallic bottle 2 shown in FIG. 5 resulting in false spoilage.

Due to the limitations associated with known methods and prior art apparatus used to form and seal ROPP closures to metallic bottles, there is an unmet need for a threaded metallic closure configured to seal a threaded metallic bottle and methods and apparatus of forming a threaded metallic closure that requires less force from a capping apparatus to seal a threaded metallic bottle. There is also an unmet need for methods and apparatus of sealing metallic bottles that may be used to seal metallic bottles formed with thinner bodies and less material (hereinafter "light-weight" metallic bottles).

SUMMARY

The present disclosure provides methods and apparatus of forming a metallic closure prior to placing the metallic closure on a metallic bottle. In one embodiment, the metallic closure includes a peripheral channel which is formed prior to placing the metallic closure on a metallic bottle. By pre-forming the peripheral channel, the amount of a top-load required to press a liner of the metallic closure against a curl of the metallic bottle to form a seal is reduced. In one embodiment, a metallic closure of the present disclosure requires only approximately 55% of the top-load required to seal a prior art ROPP closure which applies at least approximately 270 lbs. of top-load force to a metallic bottle. More specifically, the top-load applied by a capping apparatus of the present disclosure to a metallic closure of one embodiment is reduced to between approximately 50 lbs. and approximately 170 lbs. By reducing the top-load required to form a seal between the metallic closure and the metallic bottle, the metallic bottle can be formed of metallic material that is thinner than the material used to form a prior art metallic bottle. In this manner, the methods and apparatus of the present disclosure reduce the amount of metallic material required to form a metallic bottle and thereby reduce the cost of the metallic bottle of the present disclosure compared to a prior art metallic bottle. Additionally, or alternatively, the threads of the metallic bottle and the metallic closure of the present disclosure can be deeper and more overhung than threads of prior art metallic bottle and ROPP closures.

One aspect of the present disclosure is a metallic closure which includes a channel formed before the metallic closure is placed on a metallic bottle. It is another aspect of the present disclosure to provide a channel forming apparatus with tools configured to form a channel in a metallic closure prior to placing the metallic closure on a metallic bottle. In one embodiment, the channel has a depth of between approximately 0.050 inches and approximately 0.095 inches.

Another aspect of the present disclosure is an apparatus and method of forming a thread on a body portion of a metallic closure before the metallic closure is placed on a metallic bottle. Accordingly, in one embodiment, a capping apparatus does not need to press against a metallic bottle with a thread roller or other tool to form a thread on a metallic closure of the present disclosure. In one embodiment, a capping apparatus of the present disclosure can seal a metallic closure to a metallic bottle without a thread roller. The metallic closure of the present disclosure thus reduces the amount of side-load applied to the metallic bottle by a capping apparatus compared to a prior art ROPP closure on which threads are formed by a capping apparatus which includes a thread roller. Optionally, in one embodiment, a thread is at least partially formed on the metallic closure before the metallic closure is used to seal a metallic bottle. After a metallic closure with a partially formed thread is positioned on a metallic bottle, a tool, such as a thread roller, of a capping apparatus can further form the closure thread. The tool can apply less side-load force to complete the thread compared to the side-load force of the prior art thread rollers. In one embodiment, a capping apparatus of the present disclosure rotates one or more of the metallic closure and a threaded metallic bottle to screw the metallic closure onto the metallic bottle to seal the metallic bottle.

One aspect of the present disclosure is a capping apparatus that operates to seal a metallic bottle with a metallic closure that includes a preformed channel and, optionally threads. The capping apparatus is configured to rotate one or more of the metallic bottle and the metallic closure in a closing direction to seal the metallic bottle. In one embodiment, the cumulative load (including the top-load and the side-load) applied by the capping apparatus to seal a metallic bottle with a metallic closure of the present disclosure is less than approximately 250 pounds. In another embodiment, the cumulative load is between approximately 70 lbs. and approximately 250 pounds.

One aspect of the present disclosure is a metallic closure which is threaded before being placed on a metallic bottle. The metallic closure can include a closure thread which has a depth that is greater than closure threads of prior art ROPP closures. More specifically, in one embodiment, the closure thread has a depth of a least approximately 0.0230 inches. Optionally, the thread depth can be up to approximately 0.040 inches. In one embodiment, the thread depth of the metallic closure is between approximately 0.02 inches and approximately 0.045 inches.

In another embodiment, the closure thread has a different shape than threads of prior art ROPP closures. In one embodiment, the closure thread of the metallic closure is overhung to generate better engagement with bottle threads of a metallic bottle. More specifically, the closure thread can include at least one segment that has a decreased angle to a horizontal plane than a prior art closure thread.

One aspect of the present disclosure is a method and apparatus of sealing a reduced strength metallic bottle with a metallic closure. A metallic closure is provided. The metallic closure includes a peripheral channel. A thread is formed on a body portion of the metallic closure. The threaded metallic closure is positioned on a threaded neck of the metallic bottle. At least one of the threaded metallic closure and the metallic bottle are rotated to screw the metallic closure and the metallic bottle together. In this manner, a curl of the metallic bottle is driven into a liner positioned within the threaded metallic closure. Optionally, a pilfer roller can tuck a pilfer band of the threaded metallic closure against a skirt of the metallic bottle.

In one embodiment, the metallic bottle is formed of less material than a prior art metallic bottle of the same size and shape. Optionally, the metal material of the metallic bottle is thinner in one or more areas than the prior art metallic bottle. Additionally, or alternatively, the metallic bottle can optionally be formed of a different metal alloy than the prior art metallic bottle. More specifically, in one embodiment, the metallic bottle is formed of a metal material with a thickness that is at least approximately 10 percent thinner than a prior art metallic bottle having a thickness of 0.0092 inches. Optionally, the metal material of the metallic bottle can have a thickness that is between approximately 70% and approximately 95% of the thickness of a prior art metallic bottle. In another embodiment, the metallic bottle has a thickness of less than approximately 0.0085 inches. In one embodiment, the thickness of the metallic bottle is between approximately 0.009 inches and approximately 0.0085 inches. In yet another embodiment, the thickness of the metallic bottle is between approximately 0.009 inches and approximately 0.0040 inches. In one embodiment, the metallic bottle has threads with a depth of between approximately 0.0230 inches and approximately 0.040 inches.

Another aspect of the present disclosure is a metallic bottle sealed by a threaded metallic closure. In one embodiment, the threaded metallic closure includes closure threads formed before the metallic closure is positioned on the metallic bottle. Optionally, a channel can be formed on the threaded metallic closure before the threaded metallic closure is positioned on the metallic bottle. The metallic bottle and the threaded metallic closure have threads of a predetermined depth. Optionally, the depth of the threads is between approximately 0.0230 inches and approximately 0.040 inches.

In one embodiment, the metallic bottle is formed of a metal material of a thinner gage than a prior art metallic bottle. In another embodiment, the metallic bottle can withstand an internal pressure of at least approximately 100 PSI, or between approximately 103 PSI and approximately 130 PSI without venting. In yet another embodiment, the metallic bottle can withstand at least approximately 135 PSI without blow-off of the threaded metallic closure. In still another embodiment, the threaded metallic closure can be rotated in an opening direction with less than approximately 16 in. lbs. of torque, or between approximately 10 in. lbs. and approximately 15 in. lbs. of torque.

It is one aspect of the present disclosure to provide an apparatus to form a channel in a metallic closure. The apparatus includes, but is not limited to: (1) an outer tool with a body and a cavity formed therein; and (2) an inner tool including a body portion, a projection with a reduced diameter extending from a forward end of the body portion, the projection including an end-wall. When the metallic closure is positioned between the outer tool and the inner tool, the inner and outer tools can apply a force to the metallic closure to form the channel around a perimeter of a closed end-wall of the metallic closure. The apparatus operates to form the channel in the metallic closure before the metallic closure is positioned on a metallic bottle. In one embodiment, the inner and outer tools are configured to form the channel with a depth of between approximately 0.050 inches and approximately 0.100 inches. The channel can be formed before the metallic closure is positioned on a metallic bottle. One or more of the inner and outer tools can move together to apply the force to the metallic closure. The force can draw a portion of the closed end-wall toward the outer tool to form the channel.

In one embodiment, cavity of the outer tool includes an interior sidewall interconnected to an end ring by a first radius of curvature. The first radius of curvature can be between approximately 0.01 inches and approximately 0.03 inches. Optionally, the cavity has an interior diameter of between approximately 1.350 inches and approximately 1.400 inches. The cavity can optionally have a stepped cross-sectional profile. More specifically, a shoulder can be formed in the cavity to define a first portion of the cavity with a first interior diameter and a second portion of the cavity with a second interior diameter. The first interior diameter can be at least equal to an exterior diameter of the closed end-wall of the metallic closure. Optionally, the first interior diameter is between approximately 1.40 inches and approximately 1.60 inches.

The second interior diameter can be less than the first diameter. In one embodiment, the second interior diameter is less than the exterior diameter of the closed end-wall of the metallic closure. More specifically, the second interior diameter can optionally be between approximately 1.350 inches and approximately 1.410 inches.

Additionally, the cavity can have a depth of between approximately 0.090 inches and approximately 0.25 inches. In one embodiment, the cavity extends through the outer tool to define an aperture through the outer tool.

In one embodiment, the outer tool is interconnected to an outer tool retainer of the apparatus. The outer tool retainer can be interconnected to a first spacer. The apparatus can also include an ejector that is operable to project at least partially into the cavity of the outer tool. The ejector may be biased with respect to the outer tool and the first spacer. More specifically, a biasing element, such as a spring, can be positioned between the first spacer and the ejector. In one embodiment, the biasing element urges the ejector toward the outer tool.

The body portion of the inner tool can have a generally cylindrical shape. An exterior diameter of the body portion can be between approximately 1.40 inches and approximately 1.50 inches.

The projection of the inner tool can extend from the forward end of the body portion by between approximately 0.080 inches and approximately 0.14 inches. Optionally, the projection has a shape that is generally cylindrical with an exterior diameter that is less than the exterior diameter of the body portion of the inner tool. The projection exterior diameter can be between approximately 1.25 inches and approximately 1.45 inches. In one embodiment, the end-wall of the projection is generally planar or linear. In another embodiment, a second radius of curvature is formed between the projection and the end-wall, the second radius of curvature being between approximately 0.01 inches and approximately 0.03 inches.

In one embodiment, at least one cavity is formed within the inner tool. More specifically, the inner tool can include one or more of a first cavity, a second cavity, and an aperture. The first cavity can include an opening facing away from the projection. The second cavity can have an interior diameter that is less than an interior diameter of the first cavity. A shoulder can be formed between the first cavity and the second cavity. The aperture extends from the second cavity through the end-wall of the projection. An interior diameter of the aperture can be less than the interior diameter of the second cavity to define a second shoulder between the second cavity and the aperture.

In one embodiment, the inner tool includes a flange. The flange can extend from the body opposite to the projection. The flange is configured to engage an inner tool retainer of the apparatus. In one embodiment, the inner tool retainer can be interconnected to a second spacer of the apparatus. A biasing element can be positioned between the inner tool and the second spacer. In one embodiment, the biasing element includes a first biasing element that engages a shoulder between the first cavity and the second cavity. Optionally, a second biasing element can be positioned within the first biasing element. The second biasing element can engage a sleeve bearing configured to be positioned within the second cavity. In one embodiment, the sleeve bearing can extend at least partially through the aperture through the end-wall of the projection.

One aspect of the present disclosure is an apparatus to form a metallic closure having a closed end-wall and a cylindrical body. The apparatus comprises: (1) a tool operable to apply a force to the cylindrical body; (2) a mandrel having a body portion sized to fit at least partially into an open end of the cylindrical body; and (3) at least one depression formed in the mandrel body portion, the depression having a geometry configured to form a thread on the cylindrical body of the metallic closure as the tool applies a side-load to the mandrel body portion. In one embodiment, the metallic closure is a pre-formed pilfer proof closure. The depression can optionally have a geometry to form a thread with a depth of between approximately 0.023 inches and approximately 0.03 inches. The tool can optionally be a thread roller.

Optionally, the apparatus further comprises a chuck. The chuck is configured to orient the metallic closure in a predetermined alignment with respect to the mandrel. In one embodiment, the chuck is configured to rotate the metallic closure around a longitudinal axis of the metallic closure. Additionally, or alternatively, the mandrel can rotate around the longitudinal axis of the metallic closure. Accordingly, one or more of the chuck and the mandrel can rotate in an opening direction to separate the mandrel and the metallic closure after the thread has been formed.

In one embodiment, the apparatus further comprises tools to form a channel around an upper perimeter edge of the closed end-wall of the metallic closure. The tools include an inner tool and an outer tool. The inner tool includes: (A) a body portion with a sidewall that is generally cylindrical; (B) a projection with a reduced diameter extending from an end of the body portion; and (C) an end-wall of the projection configured to apply a force to an interior surface of the closed end-wall of the metallic closure. In one embodiment, the outer tool includes: (A) a body; and (B) a cavity formed in the body. The cavity has an interior diameter sufficient to receive a portion of the closed end-wall of the metallic closure as the inner tool applies the force to the interior surface of the closed end-wall. In one embodiment, the interior diameter of the cavity is between approximately 1.360 inches and approximately 1.400 inches. In one embodiment, the cavity includes an interior sidewall with a radius of curvature. The radius of curvature can be between approximately 0.01 inches and approximately 0.03 inches. At least a predetermined portion of the interior sidewall is polished to a specified smoothness. Optionally, the cavity of the body has a depth of between approximately 0.090 inches and approximately 0.34 inches.

Another aspect is a method of forming a metallic closure configured to seal a threaded neck of a metallic bottle. The method includes, but is not limited to: (1) aligning the metallic closure with an inner tool and an outer tool of a channel forming apparatus; (2) moving at least one of the inner tool, the outer tool and the metallic closure to form a channel in an outer perimeter edge of the metallic closure, the channel formed (or positioned) between a cylindrical body and a closed end-wall of the metallic closure. The channel is formed before the metallic closure is positioned on a metallic bottle. Optionally, the channel can have a depth of between approximately 0.05 inches and approximately 0.095 inches. In one embodiment, the metallic closure is a pre-formed pilfer proof closure.

In one embodiment, the aligning includes positioning the metallic closure on the inner tool. In another embodiment, forming the channel includes moving the outer perimeter edge of the metallic closure into contact with a shoulder formed within a cavity of the outer tool. Forming the channel can also include extending a portion of the closed end-wall into a second portion of the cavity.

The method can optionally include applying a side-load to the cylindrical body of the metallic closure to form a closure thread on the metallic closure. The closure thread is formed on the metallic closure before the metallic closure is positioned on the threaded neck of the metallic bottle.

In one embodiment, the method further comprises aligning the metallic closure with a threaded mandrel before applying the side-load to the metallic closure to form the closure thread. In another embodiment, the threaded mandrel includes a body portion with a least one depression configured to guide a tool which applies the side-load to the cylindrical body of the metallic closure. When the tool applies the side-load, the depression guides the tool to form the closure thread. Optionally, the tool can be a thread roller. In one embodiment, the method includes separating the metallic closure from the threaded mandrel. Separating the metallic closure from the threaded mandrel can include rotating at least one of the metallic closure and the threaded mandrel around a longitudinal axis of the metallic closure.

The inner tool can comprise a body with an extension configured to apply a force to an interior surface of the closed end-wall. In response to the force, the closed end-wall extends away from the cylindrical body of the metallic closure into a cavity of the outer tool to form the channel. In one embodiment, an exterior surface of the closed end-wall is supported by an ejector as the channel is formed. The ejector can be configured to project at least partially into a cavity of the outer tool.

Yet another aspect of the present disclosure is to provide a pre-formed metallic closure. The metallic closure is configured to seal a metallic bottle with a threaded neck and generally comprises: (1) a closed end-wall; (2) a channel around a perimeter of the closed end-wall; (3) a cylindrical body extending from the channel, the cylindrical body having a greater diameter than the channel; and, optionally, (4) a thread formed on the cylindrical body. The optional thread can have a depth of between approximately 0.0235 inches and approximately 0.04 inches. In one embodiment, the channel has a depth of between approximately 0.05 inches and approximately 0.095 inches.

In one embodiment, the pre-formed metallic closure is a pre-formed pilfer proof closure. Accordingly, the pre-formed closure can optionally further include a pilfer band. The pilfer band extends from a lowermost portion of the cylindrical body. In one embodiment, a score or perforations are formed between the pilfer band and the cylindrical body. In another embodiment, the pilfer band has a shape that is generally cylindrical. More specifically, a first longitudinal portion (or cross-section) of the pilfer band is substantially parallel to a second longitudinal portion (or cross-section) of the pilfer band.

Still another aspect of the present invention is a capping apparatus operable to seal a metallic bottle with a metallic closure. The capping apparatus comprises: (1) a chuck configured to align the metallic closure with the metallic bottle; and (2) a pilfer roller. In one embodiment, the chuck is configured to apply a predetermined top-load to the metallic closure. The top-load is selected to drive a curl of the metallic bottle at least partially into a liner positioned within the metallic closure. Optionally, the chuck is configured to rotate around a longitudinal axis of the metallic bottle. Accordingly, in one embodiment, the chuck can screw the metallic closure onto bottle threads formed on a neck of the metallic bottle.

In one embodiment, the capping apparatus further includes a holder configured to engage the metallic bottle. Additionally, or alternatively, the capping apparatus can include a bottom chuck to engage the metallic bottle. In one embodiment, one or more of the holder and the bottom chuck are configured to rotate the metallic bottle around the longitudinal axis of the metallic bottle. The holder and the bottom chuck can thus screw the metallic closure onto bottle threads of the metallic bottle.

The apparatus can further include a torque limiting element. The torque limiting element is configured to limit the torque at which the metallic closure is screwed onto the metallic bottle. In one embodiment, the torque limiting element is associated with one or more of the chuck, the holder, and the bottom chuck.

The apparatus optionally includes a tool, such as a thread roller. In one embodiment, the tool is configured to form a closure thread on the metallic closure. In another embodiment, the tool is configured to complete a partial thread formed on the metallic closure before the metallic closure is positioned on the metallic bottle. More specifically, in one embodiment the tool is configured to alter the geometry of a thread previously formed on the metallic closure. In one embodiment, the tool can increase a depth of the thread.

The terms "metal" or "metallic" as used hereinto refer to any metallic material that can be used to form a container or a closure, including without limitation aluminum, steel, tin, and any combination thereof. However, it will be appreciated that the apparatus and method of the present disclosure can be used to form threaded containers of any material, including paper, plastic, and glass.

The term "thread" or "threads" as used herein refers to any type of helical structure used to convert a rotational force to linear motion. A thread can be symmetric or asymmetric, of any predetermined size, shape, or pitch, and can have a clockwise or counter-clockwise wrap. A thread can extend a least partially around a metallic closure or a metallic bottle. In one embodiment, the thread can extend at least 360° around a metallic closure or a metallic bottle. Optionally, the thread can extend at least two times around the metallic closure or the metallic bottle, or alternatively, less than 360°. In another embodiment, a metallic closure or a metallic bottle can have two or more threads which have the same or different lengths. Additionally, it will be appreciated by one of skill in the art, that both helical threads and lug threads can be used with metallic closures and metallic bottles of the present invention.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the terms "about" or "approximately." Accordingly, unless otherwise indicated, all numbers expressing quantities, dimensions, conditions, ratios, ranges, and so forth used in the specification and claims can be increased or decreased by approximately 5% to achieve satisfactory results. In addition, all ranges described herein can be reduced to any sub-range or portion of the range, or to any value within the range without deviating from the invention. For example, the range "5 to 55" includes, but is not limited to, the sub-range "5 to 20" as well as the sub-range "17 to 54."

Although various dimensions and quantities have been provided to describe aspects of the present disclosure, it is expressly contemplated that dimensions can be varied in threaded metallic closures and metallic bottles that still comport with the scope and spirit of the present disclosure.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Field, Summary, Brief Description of the Drawings, Detailed Description, Abstract, and Claims themselves.

The Summary is neither intended, nor should it be construed, as being representative of the full extent and scope of the present disclosure. Moreover, references made herein to "the present invention," "the present disclosure," or aspects thereof should be understood to mean certain embodiments of the present disclosure and should not necessarily be construed as limiting all embodiments to a particular description. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the disclosure and together with the Summary given above and the Detailed Description given below serve to explain the principles of these embodiments. In certain instances, details that are not necessary for an understanding of the disclosure or that render other details difficult to perceive may have been omitted. Additionally, it should be understood that the drawings are not necessarily to scale.

It should also be understood that the present disclosure is not necessarily limited to the particular embodiments illustrated herein. Other embodiments are possible using, alone or in combination, one or more of the features set forth above or described below. For example, it is contemplated that various features and devices shown and/or described with respect to one embodiment can be combined with or substituted for features or devices of other embodiments regardless of whether or not such a combination or substitution is specifically shown or described herein.

Figure 1B:
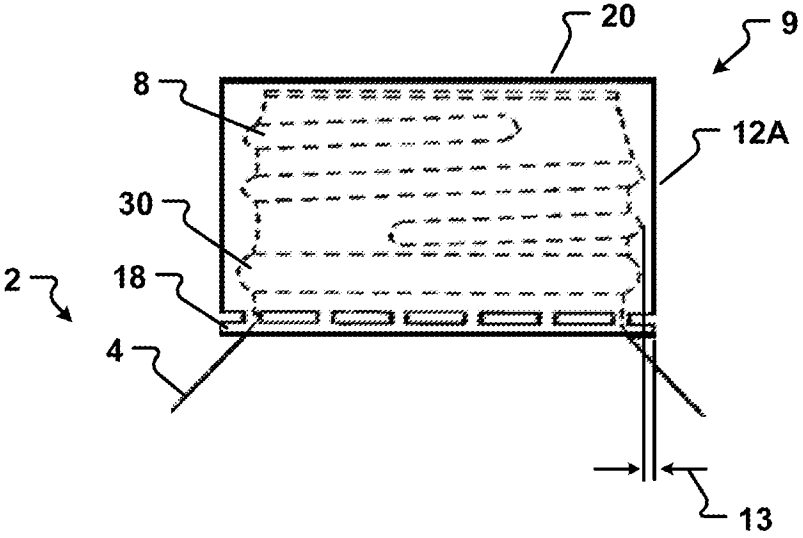
Fig. 1B (Prior Art)
FIGS. 1A-1D illustrate a method of sealing a metallic bottle with a ROPP closure using a prior art capping apparatus.
Figure 1A:
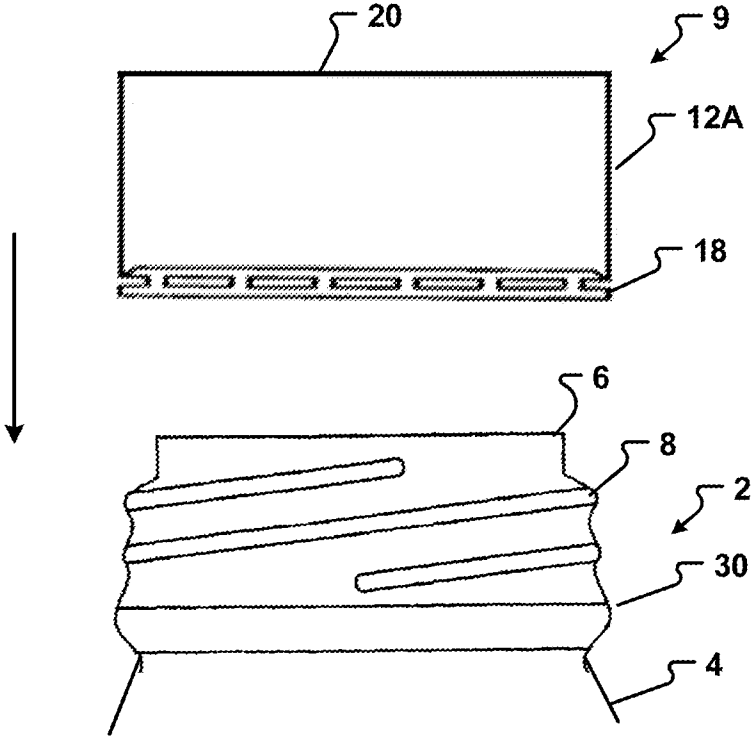
Fig. 1A (Prior Art)

To assist in the understanding of one embodiment of the present disclosure the following list of components and associated numbering found in the drawings is provided herein:

| Number | Component |
|---|---|
| 2 | Metallic bottle |
| 3 | Bottle axis |
| 4 | Neck portion |
| 5 | Diameter |
| 6 | Curl |
| 8 | Bottle threads |
| 9 | ROPP shell |
| 10 | ROPP closure |
| 11 | Axis of ROPP closure |
| 12 | Body portion of ROPP closure |
| 13 | Gap |
| 14 | ROPP liner |
| 16 | Closure threads |
| 18 | Pilfer band |
| 19 | Flared portion of pilfer band |
| 20 | Top portion of ROPP closure |
| 22 | Prior art capping apparatus |
| 24 | Pressure block ejector |
| 25 | Pressure block |
| 26 | Thread roller |
| 28 | Pilfer roller |
| 30 | Skirt of metallic bottle |
| 32 | Channel of closure |
| 33 | Channel depth |
| 34 | Side-load force |
| 35 | Roller re-set point |
| 36 | Top-load force |
| 38 | Side-load force |
| 39 | Roller re-set point |
| 40 | Top-load force |

-continued

| Number | Component |
|---|---|
| 41 | Initial Top-load force spike |
| 42 | Failure region |
| 44 | Failure threshold |
| 46 | Cumulative load |
| 47 | Margin between nominal load and failure threshold |
| 50 | Method |
| 52 | Form a body of a metallic closure |
| 54 | Position a liner in the body of the metallic closure |
| 56 | Form a channel in the metallic closure |
| 58 | Position a liner in the metallic closure |
| 60 | Optionally pre-thread the body of the metallic closure |
| 62 | Align the metallic closure with a metallic bottle |
| 64 | Interconnect the metallic closure to the metallic bottle |
| 66 | Metallic closure |
| 67 | Axis of metallic closure |
| 68 | Closed end-wall |
| 70 | Channel |
| 72 | Channel depth |
| 74 | Body portion |
| 75 | Closure thread valley |
| 76 | Closure threads |
| 77 | Closure thread depth |
| 78 | Open end |
| 79 | Closure thread peak |
| 80 | Pilfer band |
| 81 | Overhung segment of closure threads |
| 82 | Perforations |
| 83 | Channel forming apparatus |
| 84 | Liner |
| 85 | Outer channel forming tool |
| 86 | Inner channel forming tool |
| 87 | Flange |
| 88 | Body portion |
| 89 | Shoulder |
| 90 | Body outer diameter |
| 91 | Body height |
| 92 | Projection |
| 93 | Projection sidewall |
| 94 | Projection outer diameter |
| 95 | Flange outer diameter |
| 96 | Projection height |
| 98 | Planar end-wall |
| 99 | Body of outer tool |
| 100 | Cavity or aperture of outer tool |
| 101 | Interior sidewall of outer tool |
| 101A | First interior sidewall |
| 101B | Second interior sidewall |
| 102 | End ring of outer tool |
| 103 | Cavity depth |
| 104 | Threaded mandrel |
| 106 | Mandrel body |
| 108 | Mandrel sidewall |
| 109 | Thread forming apparatus |
| 110 | Thread projection |
| 112 | Thread depressions |
| 114 | Tool for forming threads |
| 116 | Metallic bottle |
| 118 | Bottle axis |
| 120 | Closed end |
| 122 | Body portion |
| 124 | Neck portion |
| 126 | Pilfer skirt |
| 128 | Curl |
| 129 | Bottle thread peak |
| 130 | Bottle threads |
| 131 | Bottle thread depth |
| 132 | Opening of bottle |
| 133 | Bottle thread valley |
| 134 | Curl outside diameter |
| 135 | Overhung segment |
| 136 | Thread overlap |
| 137 | Thread clearance |

-continued

| Number | Component |
|---|---|
| 138 | Capping apparatus |
| 139 | Horizontal plane |
| 140 | Chuck |
| 142 | Recess |
| 144 | Chuck inner diameter |
| 146 | Closing direction of a metallic closure |
| 148 | Pilfer roller |
| 150 | Bottle holder |
| 152 | Bottom chuck |
| 154 | Closing direction of a metallic bottle |
| 156 | Shoulder of outer tool |
| 158A | Outer beveled surface of outer tool |
| 158B | Inner beveled surface of outer tool |
| 160 | Exterior diameter of outer tool |
| 162 | First interior diameter of cavity |
| 164 | Second interior diameter of cavity |
| 166 | Height of body of inner tool |
| 168 | Depth of shoulder |
| 170 | First cavity of inner tool |
| 172 | Second cavity of inner tool |
| 174 | Aperture of inner tool |
| 180 | Stop block |
| 181 | Distance between dies of channel forming apparatus |
| 182 | Spacer |
| 184 | Fastener or screw |
| 186 | Outer tool retainer |
| 188 | Distance between closure end-wall and shoulder of outer tool |
| 190 | Ejector |
| 192 | Shim |
| 194 | Biasing element, or spring |
| 196 | Flanged sleeve bearing |
| 198 | Slotted spring pin |
| 200 | Inner tool retainer |
| 202 | Distance between inner tool retainer and outer tool retainer |
| 204 | Distance between inner tool flange and inner tool retainer |
| 205 | Plane defined by thread contact point |
| 206 | Angle between thread contact point and horizontal plane |
| 208 | Force of lift on closure (or vertical force) |
| 210 | Force of closure expansion (or horizontal force) |
| 212 | Force of closure ejection |
| R1 | Radius between the interior sidewall and the end ring of the outer tool |
| R2 | Radius between a sidewall and an end-wall of the inner tool projection |
| R3 | Radius between the body and a shoulder of the inner tool |
| R4 | Radius between the first interior sidewall and the shoulder of the outer tool |
| R5 | Radius between the shoulder and the second interior sidewall |
| R6 | Radius between the shoulder and the projection sidewall of the inner tool |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, can be modified in numerous ways within the scope and spirit of the disclosure.

Figure 6:
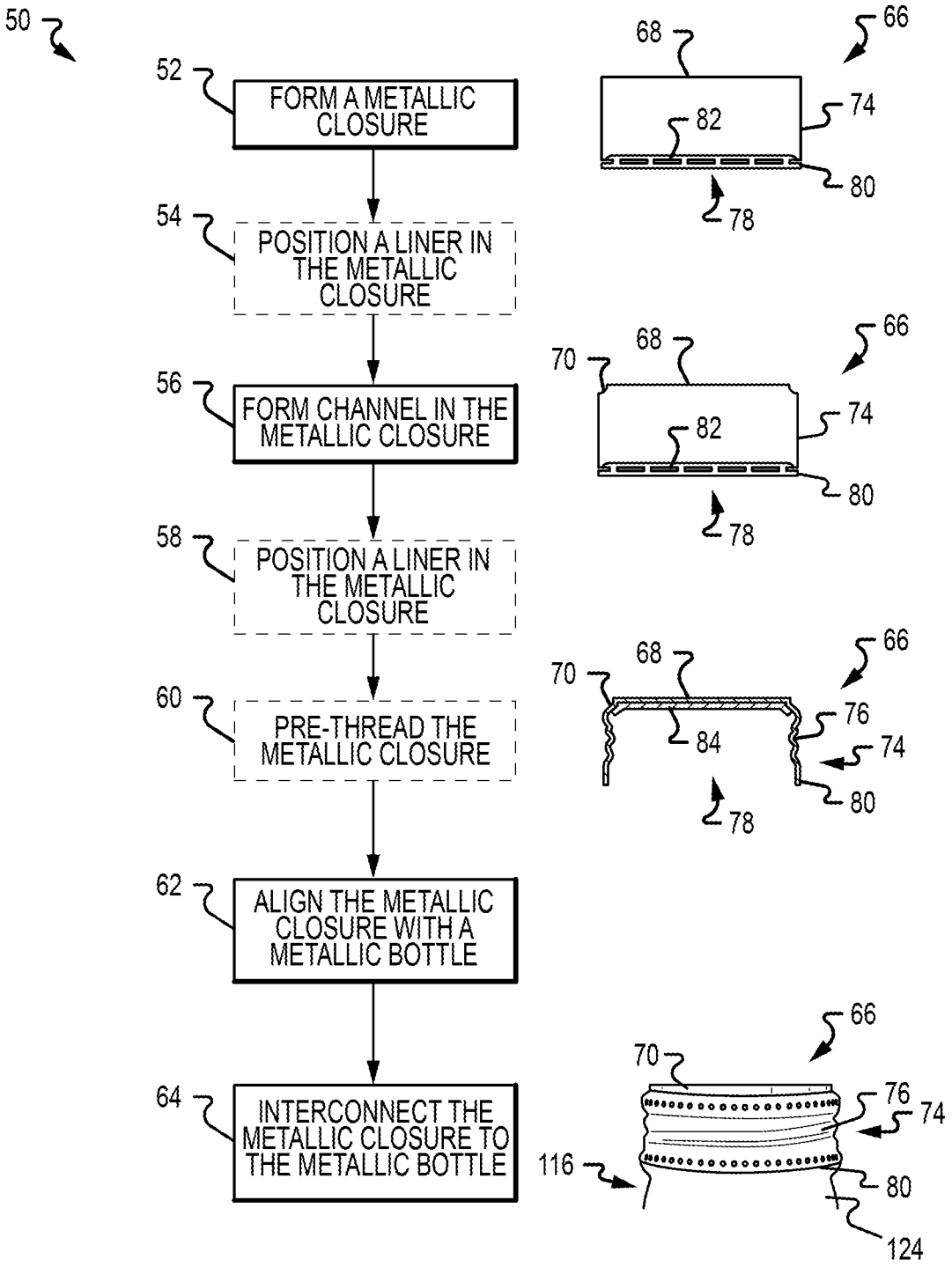
FIG. 6 is a flow chart of a method of forming a metallic closure and subsequently sealing a metallic bottle with the metallic closure according to an aspect of the present disclosure.
Figure 7B:
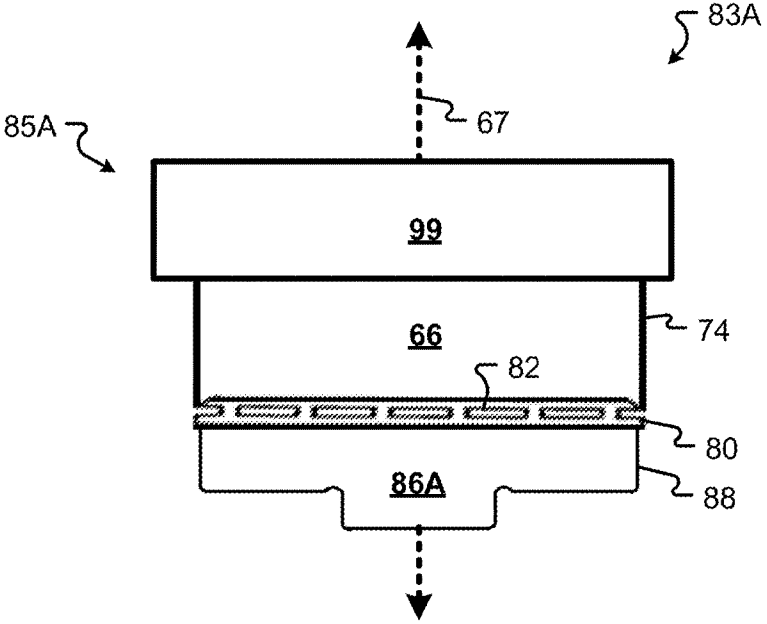
FIGS. 7A-7B are schematic illustrations of tools of an apparatus of one embodiment of the present disclosure forming a channel in a metallic closure.
Figure 7A:
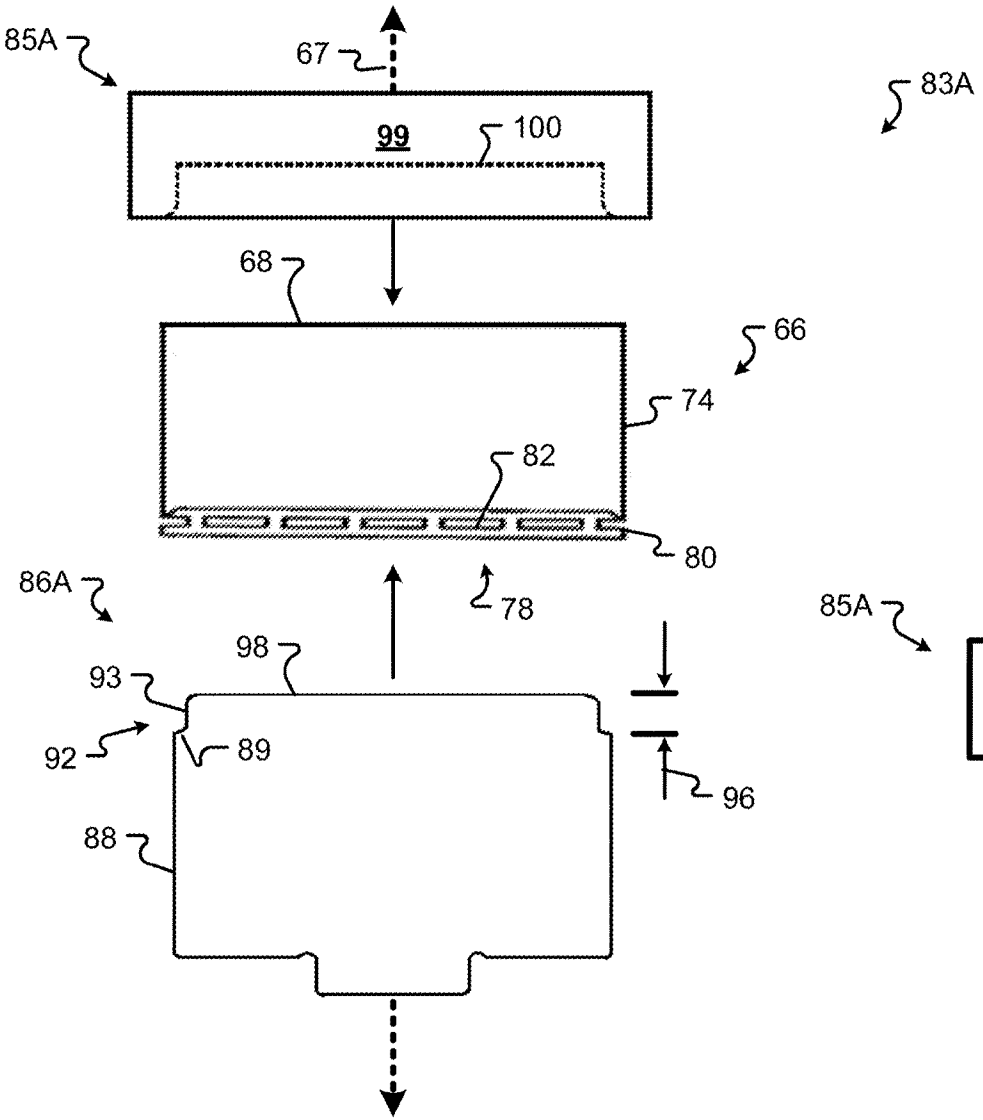

Referring now to FIG. 6, one embodiment of a method 50 of forming a metallic closure 66 and subsequently sealing a metallic bottle 116 with the metallic closure 66 is generally illustrated according the present disclosure. While a general order of operations of the method 50 is shown in FIG. 6, the method 50 can include more or fewer operations or can arrange the order of the operations differently than those shown in FIG. 6. Additionally, although the operations of method 50 may be described sequentially, many of the operations can in fact be performed in parallel or concurrently. Hereinafter, the method 50 shall be explained with reference to the apparatus, tools, metallic bottles, and threaded metallic closures described in conjunction with FIGS. 7-18.

In operation 52, a metallic closure 66 is formed. In one embodiment, the metallic closure 66 is formed by a cupping press. More specifically, the cupping press includes tools to cut a blank from a sheet of stock metal material. The cupping press then forms the blank into a generally cup-shaped metallic closure 66.

The metallic closure 66 generally includes a closed end-wall 68, a body portion 74, and an open end 78 opposite the closed end-wall. The body portion 74 extends from the closed end-wall 68 and is generally cylindrical. Optionally, the metallic closure 66 can include a pilfer band 80 interconnected to the body portion 74. In one embodiment, the cupping press includes a tool to form a score or to cut perforations 82 such that the pilfer band 80 is detachably interconnected to the body portion 74.

Operation 52 can optionally also include forming a channel 70 in the metallic closure. More specifically, the cupping press can include tools 85, 86 (illustrated in FIGS. 7-9) configured to form the channel 70. Alternatively, the channel 70 can be formed in one of operations 56 and 60. By forming a channel 70 on the metallic closure 66 before the metallic closure is positioned on a metallic bottle the magnitude of the top-load applied by a capping apparatus to the metallic bottle is significantly reduced, for example by at least approximately 40%. A prior art capping apparatus may apply a top-load of approximately 270 pounds. In one embodiment, forming the channel 70 before placing the metallic closure 66 reduces the top-load required to seal a metallic bottle to between approximately 60 pounds and approximately 180 pounds.

In optional operation 54, a liner 84 is placed in the metallic closure 66 in contact with an interior surface of the closed end-wall 68. The liner 84 can be stamped from a sheet of liner material. Alternatively, the liner 84 can be molded in place. The liner is formed of a material that is malleable or compressible. In one embodiment, the liner can comprise a plastic.

In operation 56, a channel 70 can be formed in the metallic closure 66. More specifically, and referring now to FIGS. 7A-7B, a channel forming apparatus 83A of one embodiment of the present disclosure is generally illustrated. The channel forming apparatus 83A generally includes an outer tool 85A and an inner tool 86B. In one embodiment the outer tool 85A can engage an exterior of the metallic closure 66 as the inner tool 86A is positioned within the closure open end 78. One or more of the tools 85A, 86A move together with respect to the metallic closure 66 and apply a force to at least the closed end-wall 68. In this manner, the inner tool 86A draws or extends a portion of the closed end-wall 68 outwardly away from the body portion 74 toward the outer tool 85 to form the channel 70.

In one embodiment, one or more of the tools 85A, 86A move generally parallel to a longitudinal axis 67 of the metallic closure 66. In another embodiment, the tools 85A, 86A are substantially co-axially aligned with the longitudinal axis 67 of the metallic closure 66. Optionally, the force applied to the metallic closure 66 by the tools 85A, 86A is up to approximately 425 pounds. In one embodiment, the tools 85A, 86A apply between approximately 75 pounds and approximately 425 pounds to the metallic closure.

Optionally, the channel 70 is formed by the tools 85A, 86A in one operation. More specifically, in one embodiment, the channel 70 is formed in a single drawing operation by the outer tool 85A and the inner tool 86A positioned within the metallic closure 66.

Figure 8A:
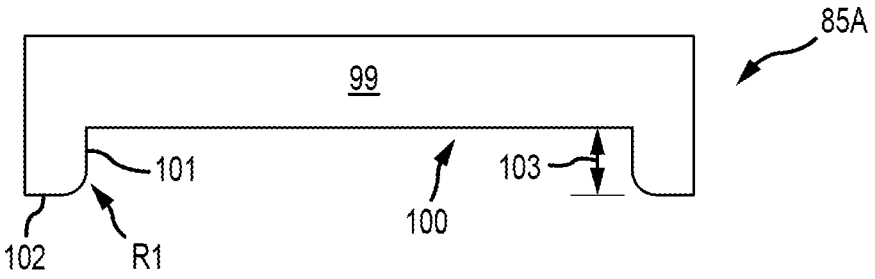
FIG. 8A is a cross-sectional front elevation view of an outer tool of one embodiment of the present disclosure configured to form a channel in a metallic closure.
Figure 8C:
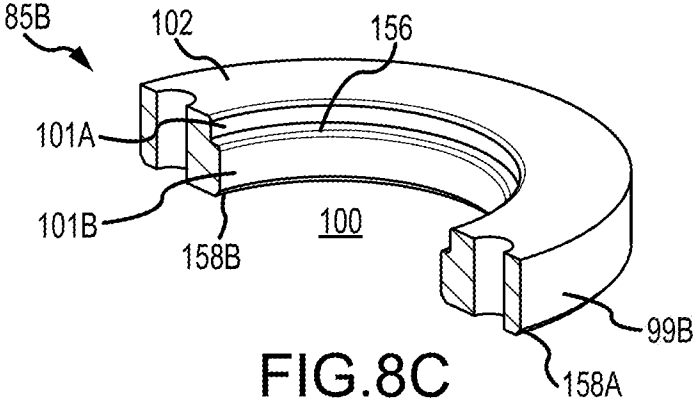
FIG. 8C is a partial perspective view of the outer tool of FIG. 8B.
Figure 8B:
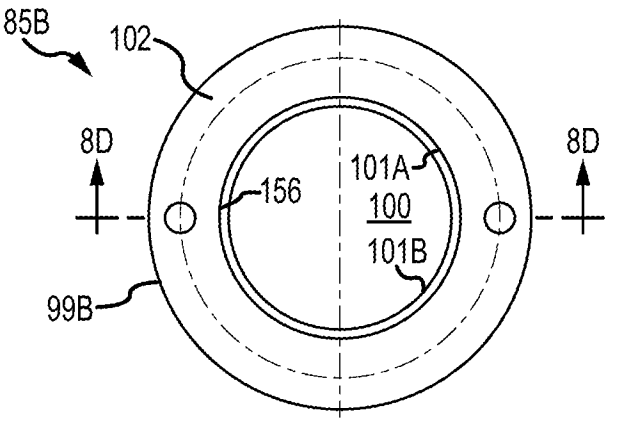
FIG. 8B is a top plan view of another embodiment of an outer tool of the present disclosure.
Figure 8E:
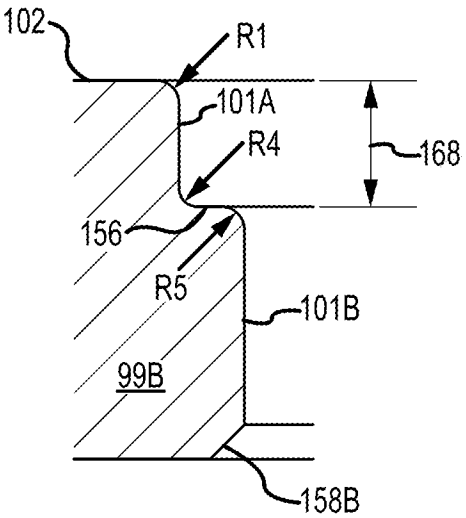
FIG. 8E is an expanded front elevation view of a portion of the outer tool of FIG. 8D.

Referring now to FIG. 8A, in one embodiment the outer tool 85A generally includes a body 99 with a cavity 100 therein. The cavity 100 has an interior diameter sufficient to receive a portion of the closed end-wall 68 of the metallic closure 66 as the inner tool 86 applies the force to the interior surface of the closed end-wall 68. In one embodiment, the interior diameter of at least a portion of the cavity 100 is between approximately 1.360 inches and approximately 1.400 inches. In one embodiment, the cavity 100 includes an interior sidewall 101. A radius of curvature R1 is formed between the interior sidewall 101 and an end ring 102 of the outer tool 85. The radius of curvature R1 can be between approximately 0.01 inches and approximately 0.03 inches. Optionally, the cavity 100 has a depth 103 of between approximately 0.090 inches and approximately 0.35 inches. Alternatively, the cavity 100 can extend through the body 99 to define an aperture 100.

Figure 5:
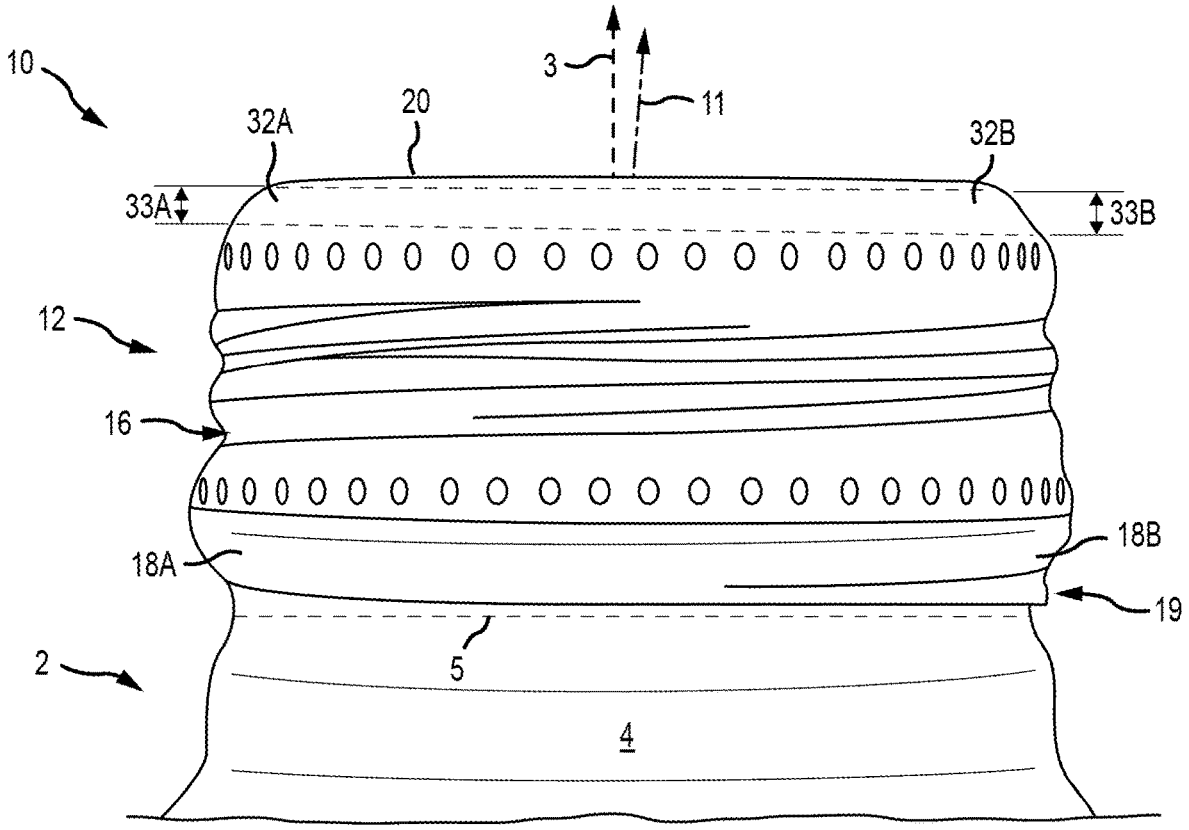
FIG.5 (PRIOR ART)
FIG. 5 is a partial front elevation view of a neck portion of a metallic bottle sealed with a prior art ROPP closure and illustrating an improper alignment of the ROPP closure with respect to the metallic bottle.
Figure 9A:
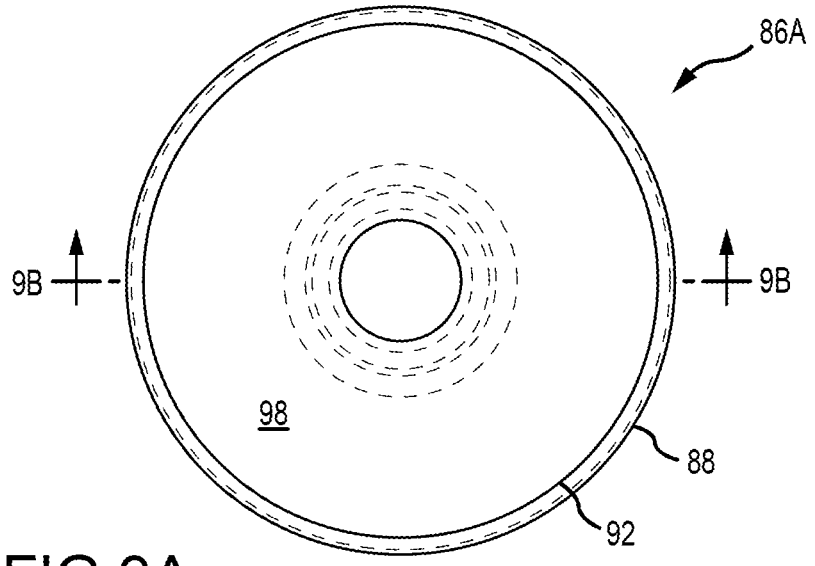
FIG. 9A is a top plan view of an embodiment of an inner tool of the present disclosure configured to form a channel in a metallic closure.
Figure 9B:
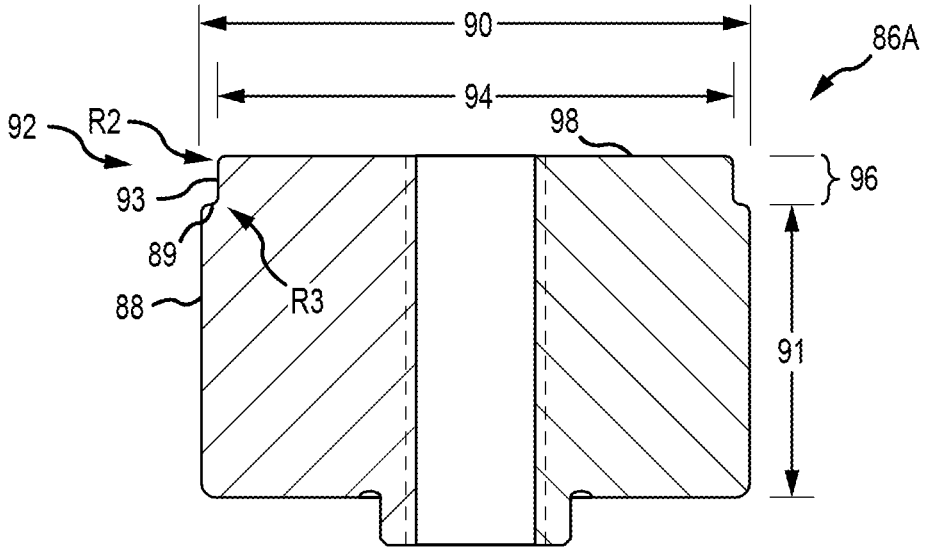
FIG. 9B is a cross-sectional front elevation view of the inner tool of FIG. 9A taken along line 9B-9B.

Referring now to FIGS. 9A-9B, in one embodiment the inner tool 86A generally includes a body portion 88 and a reform projection 92. The body portion 88 is generally cylindrical and has an outer diameter 90 and a height 91. Optionally, the outer diameter 90 can be between approximately 1.43 inches and approximately 1.48 inches. The outer diameter 90 is not greater than an interior diameter of the metallic closure 66. More specifically, in one embodiment, the clearance between the exterior surface of the body portion 88 and an interior surface of the metallic closure 66 is less than approximately 0.005 inches. Accordingly, a tight fit is achieved between metallic closure 66 and the inner tool 86. In this manner, the channel 70 formed by tools 85A, 86A is substantially symmetric and has a generally uniform depth 72 (illustrated in FIG. 12), unlike the channel 32 illustrated in FIG. 5. In one embodiment, the interior diameter of the metallic closure 66 is less than approximately 0.005 inches larger than the outer diameter 90 of the inner tool body 88. In one embodiment, the height 91 of the body portion 88 is at least approximately 0.7 inches. Optionally, the height 91 is between approximately 0.75 inches and 1.0 inches.

The projection 92 extends from the body portion 88 a predetermined height 96. The projection height 96 is selected to form a channel 70 with a predetermined depth 72. In one embodiment, the projection height 96 is between approximately 0.065 inches and approximately 0.135 inches. In another embodiment, the projection height 96 is between approximately 0.11 inches and approximately 0.14 inches. Accordingly, the projection 96 can form a channel 70 with a depth 72 of at least approximately 0.050 inches. In one embodiment, the channel 70 formed by the channel forming tool 86 has a depth 72 of at least approximately 0.080 inches. Optionally, the channel 70 formed by the projection 92 can have a depth 72 of between approximately 0.075 inches and approximately 0.095 inches.

An end-wall 98 is formed on the reform projection 92. In one embodiment, the end-wall 98 is substantially planar. The projection 92 has an outer diameter 94 that is less than the body diameter 90. In one embodiment, the projection outer diameter 94 is less than an exterior diameter 134 of a curl 128 of a metallic bottle 116 (illustrated in FIG. 15). In one embodiment, the projection outer diameter 94 is at least approximately 0.005 inches less than the curl exterior diameter 134. In this manner, when the metallic closure 66 is used to seal a metallic bottle 116, the liner 84 is interference fit with the bottle curl 128 and will compress to a custom fit with any bottle upon which the metallic closure 66 is positioned. More specifically, when a metallic closure 66 with a preformed channel 70 is used to seal a metallic bottle 116, a closure liner 84 will have at least approximately 0.005 interference fit with the bottle curl 128.

In one embodiment, the bottle curl diameter 134 (shown in FIG. 15) is between approximately 1.306 inches and approximately 1.328 inches. Accordingly, in one embodiment, the projection outer diameter 94 is not greater than approximately 1.380 inches. In another embodiment, the projection outer diameter 94 is no more than approximately 1.310 inches. Optionally, the projection outer diameter 94 is between approximately 1.295 inches and approximately 1.323 inches. In another embodiment, the projection outer diameter 94 is between approximately 1.304 inches and approximately 1.308 inches.

Optionally, a radius of curvature R2 can be formed between a sidewall 93 of the reform projection 92 and the end-wall 98. In one embodiment, the radius of curvature R2 is between approximately 0.01 inches and approximately 0.04 inches. A third radius of curvature R3 can be formed between the body portion 88 and a shoulder 89 of the projection 92. In one embodiment, the third radius of curvature R3 is between approximately 0.003 inches and approximately 0.03 inches. In another embodiment, the third radius of curvature R3 is not greater than 0.02 inches.

The end-wall 98 distributes the forming load applied to the metallic closure 66 substantially evenly to the entire closed end-wall 68. In this manner, the material of the metallic closure 66 is not thinned unevenly when the tool 86 forms the channel 70. If a liner 84 is positioned within the metallic closure 66 when the channel 70 is formed, the large surface of the end-wall 98 compresses the liner which subsequently will return to its original shape and thickness when the inner tool 86 is removed.

Figure 1C:
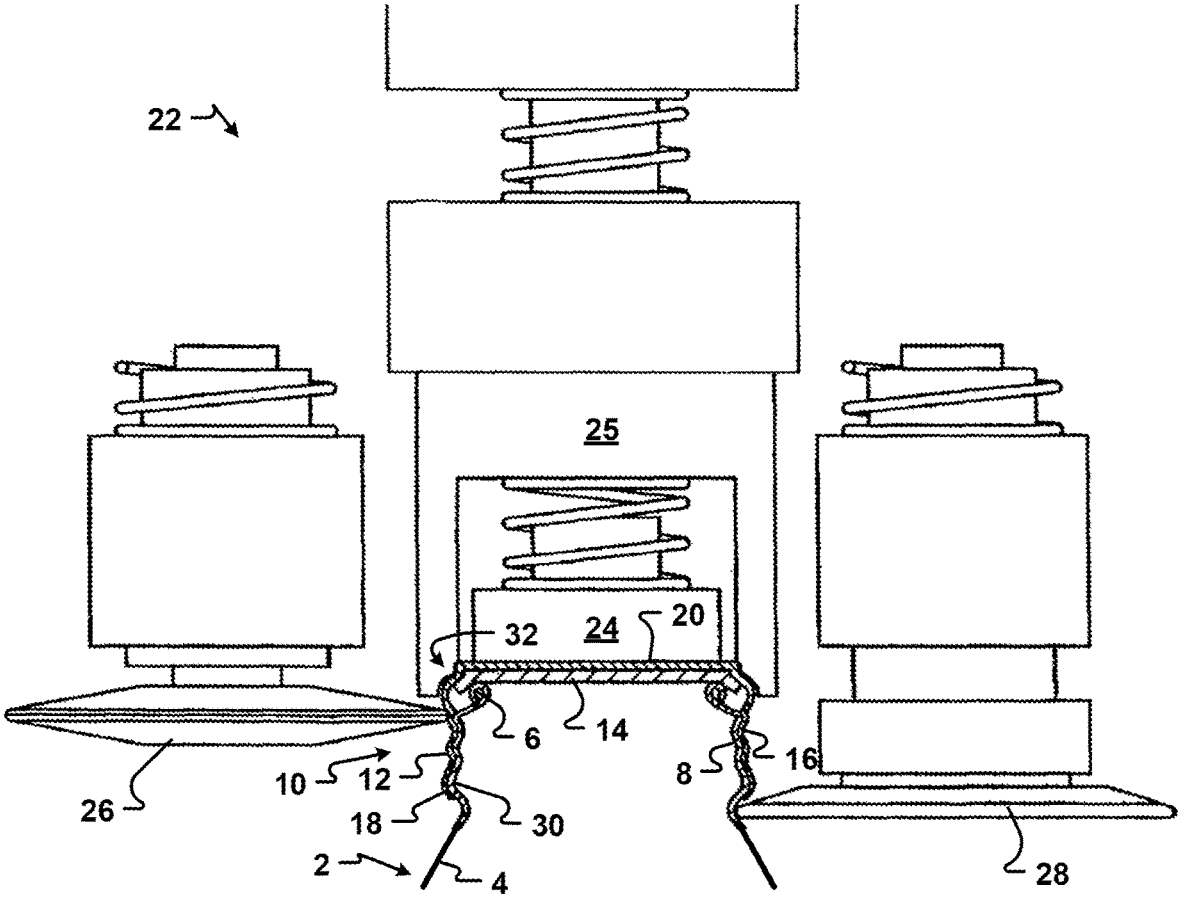
Fig. 1C (Prior Art)
Figure 1D:
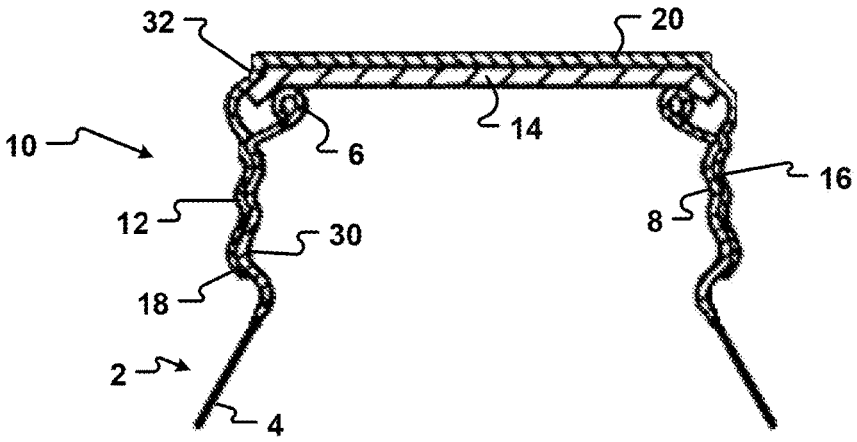
Fig. 1D (Prior Art)
Figure 1E:
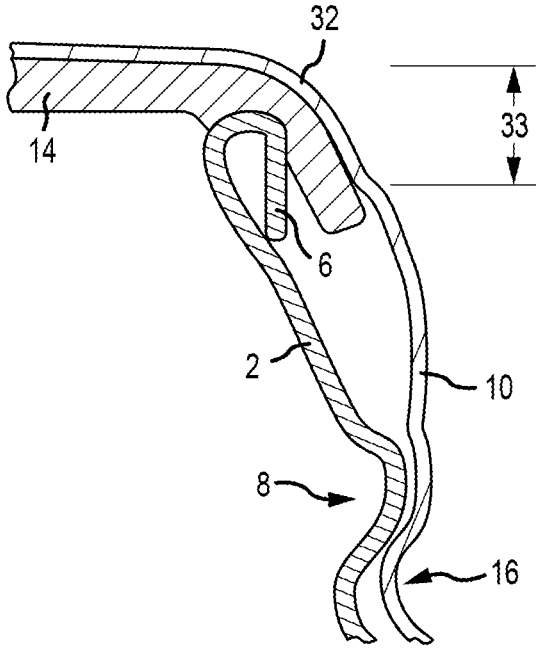
FIG.1E (PRIOR ART)
FIGS. 1E-1F are partial cross sectional side elevation views of a portion of a metallic bottle curl in contact with a liner within a ROPP closure.
Figure 1F:
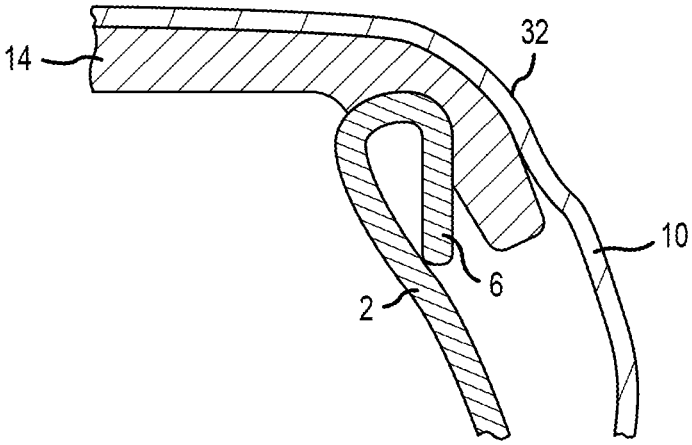
FIG.1F (PRIOR ART)

In contrast, when a prior art capping apparatus 22 presses a ROPP closure 10 against a bottle curl 6, portions of the ROPP closure 10 are unsupported as shown in FIG. 1C. If a liner 14 is positioned within the ROPP closure 10 during formation of the channel 32, then the liner may thin. More specifically, the narrow bottle curl 6 imbeds into the liner 14 and can permanently thin portions of the liner in a circular shape.

Referring now to FIGS. 8B-8E, another embodiment of an outer tool 85B of the present disclosure is generally illustrated. The outer tool 85B is similar to the outer tool 85A and includes many of the same (or similar) features and dimensions and can operate in a similar manner. The outer tool 85B includes a body 99 with an exterior diameter 160 and a predetermined height 166. In one embodiment, the body 99B is generally cylindrical. The exterior diameter 160 can be between approximately 2.38 inches and approximately 2.41 inches. Optionally, the height 166 can be at least approximately 0.25 inches and less than approximately 0.6 inches. In one embodiment, the height 166 is between approximately 0.3 inches and 0.4 inches.

An aperture 100 is formed through the body 99. The aperture 100 can include an interior sidewall 101 with a stepped profile defined by shoulder 156. More specifically, a first interior sidewall portion 101A has a first interior diameter 162. A second sidewall portion 101B has a second interior diameter 164 that is less than the first interior diameter 162. A channel 70 of the present invention can be formed by extending or drawing a closed end-wall 68 of a metallic closure 66 against the shoulder 156 and into the aperture 100B defined by the second sidewall portion 101B.

The body 99 can include a radius of curvature R1 between an end ring 102 of the body 99 and the first interior sidewall 101A. The radius of curvature R1 can be between approximately 0.01 inches and approximately 0.03 inches. Optionally, the radius of curvature R1 is between approximately 0.015 inches and approximately 0.025 inches.

The shoulder 156 is a predetermined depth 168 from the end ring 102 of the body 99. The depth 168 may optionally be between approximately 0.10 inches and approximately 0.13 inches.

The first interior diameter 162 is at least equal to an exterior diameter of a closed end-wall 68 of a metallic closure 66. In one embodiment, the first interior diameter 162 is between approximately 1.49 inches and approximately 1.52 inches.

A radius of curvature R4 can optionally be formed between the first interior sidewall portion 101A and the shoulder 156. In one embodiment, the radius of curvature R4 is between approximately 0.010 inches and approximately 0.020 inches, or between approximately 0.013 inches and approximately 0.019 inches.

The second interior diameter 164 is less than the exterior diameter of the closed end-wall 68 of a metallic closure 66. The second interior diameter 164 can optionally be between approximately 1.35 inches and approximately 1.41 inches, or between approximately 1.390 inches and approximately 1.400 inches.

One or more of the first and second interior sidewalls 101A, 101B can be polished to a predetermined smoothness. The sidewalls 101A, 101B can optionally be polished to a tolerance of less than approximately 0.01 inches. Alternatively, the tolerance can be less than approximately 0.005 inches. In one embodiment, only a portion of the second interior sidewall 101B proximate to the first interior sidewall 101A is polished. The polished portion of the second interior sidewall 101B can extend at least approximately 0.1 the aperture portion 101B measured from the shoulder 156.

A radius of curvature R5 can also be formed between the shoulder 156 and the second interior sidewall portion 101B. The radius of curvature R5 optionally is between approximately 0.01 inches and approximately 0.03 inches. In another embodiment, the radius of curvature R5 is between approximately 0.015 inches and approximately 0.025 inches.

One or more surfaces of the body 99B can be beveled. For example, the body 99B can optionally include an outer beveled surface 158A and an inner beveled surface 158B. The outer beveled surface 158 can be formed between an exterior sidewall and a lower surface opposite to the end ring 102. The inner beveled surface 158B may optionally extend between the second interior sidewall 101B and the lower surface. One or more of the beveled surfaces 158 can be set at an angle of approximately 45° to a longitudinal axis of the inner tool 85B. The beveled surfaces 158 can be of any length. In one embodiment, at least one of the beveled surfaces 158A, 158B has a length of between approximately 0.01 inches and approximately 0.08 inches.

Figure 9E:
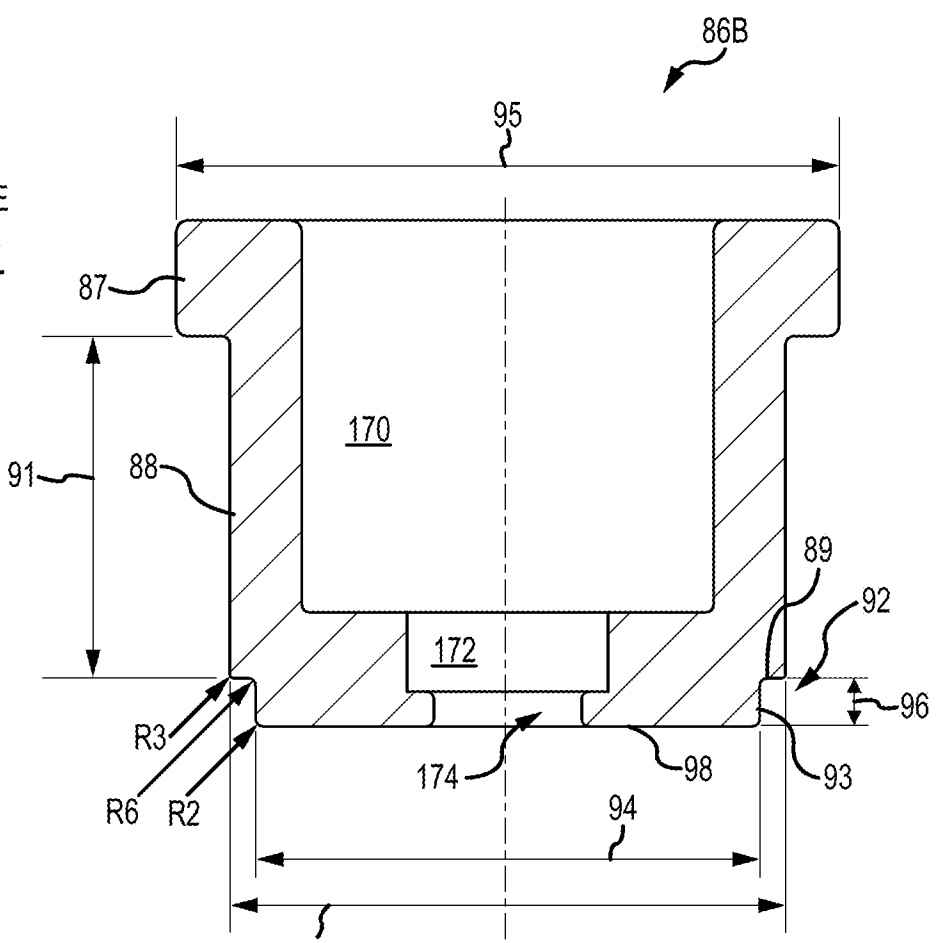
FIG. 9E is a cross-sectional front elevation view of the inner tool of FIG. 9C taken along line 9E-9E.
Figure 9C:
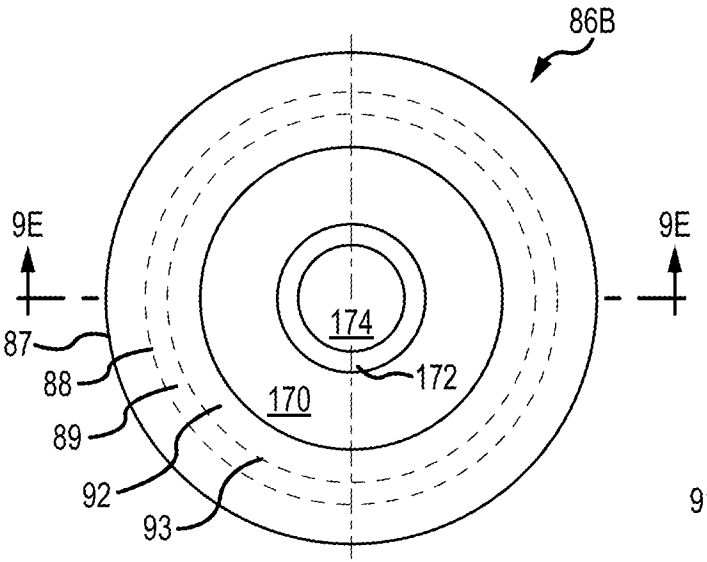
FIG. 9C is a top plan view of another embodiment of an inner tool of the present disclosure.
Figure 9D:
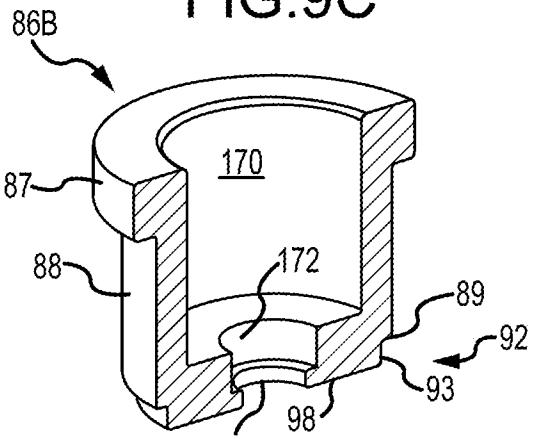
FIG. 9D is a partial front perspective view of the inner tool of FIG. 9C.

Referring now to FIGS. 9C-9E, another embodiment of an inner tool 86B of the present disclosure is generally illustrated. The inner tool 86B is similar to the inner tool 86A described in conjunction with FIGS. 7, 9 and functions in the same or a similar manner and can have the same or similar dimensions.

The inner tool 86B has a body 88 that is generally cylindrical and with a predetermined outer diameter 90. The outer diameter 90 is selected to be no greater than an interior diameter of a body 74 of a metallic closure 66. In this manner, the inner tool 86B is configured to be positioned within the metallic closure such that the inner tool 86B can apply a force to an interior surface of a closed end-wall 68 of the metallic closure to form a channel 70. Similar to inner tool 86A, the diameter 90 of inner tool 86B can be selected to form a substantially tight fit with a metallic closure 66. In this manner, inadvertent or unintended movement of the metallic closure with respect to the inner tool 86B is reduced or eliminated. In one embodiment, the outer diameter 90 of the body 88 is at least approximately 1.4 inches. The outer diameter 90 can be less than approximately 1.5 inches. Optionally, the body 88 can have an outer diameter 90 of between approximately 1.43 inches and approximately 1.45 inches.

Figure 10A:
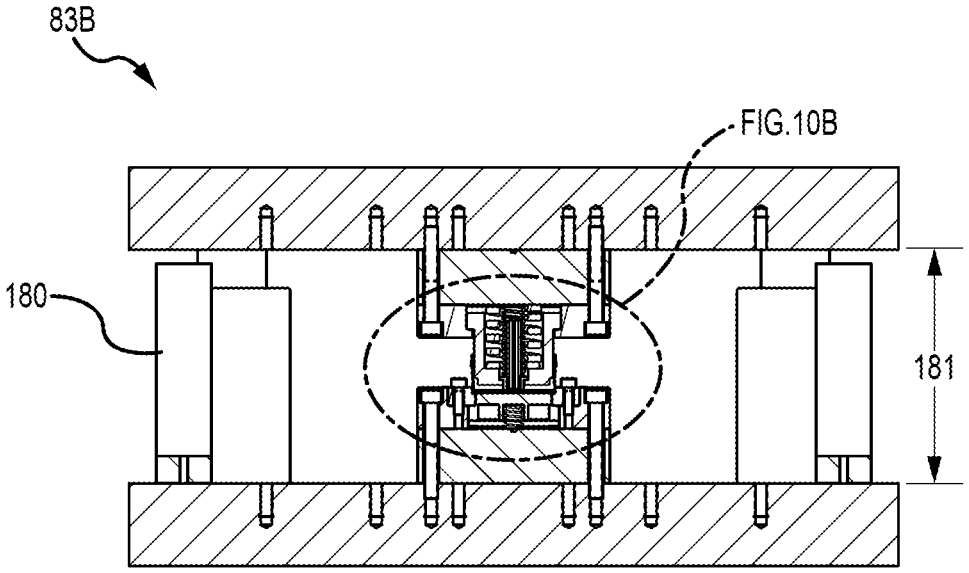
FIG. 10A is a cross-sectional front elevation view of a channel forming apparatus of an embodiment of the present disclosure illustrated in a first position prior to forming a channel in a metallic closure.
Figure 10B:
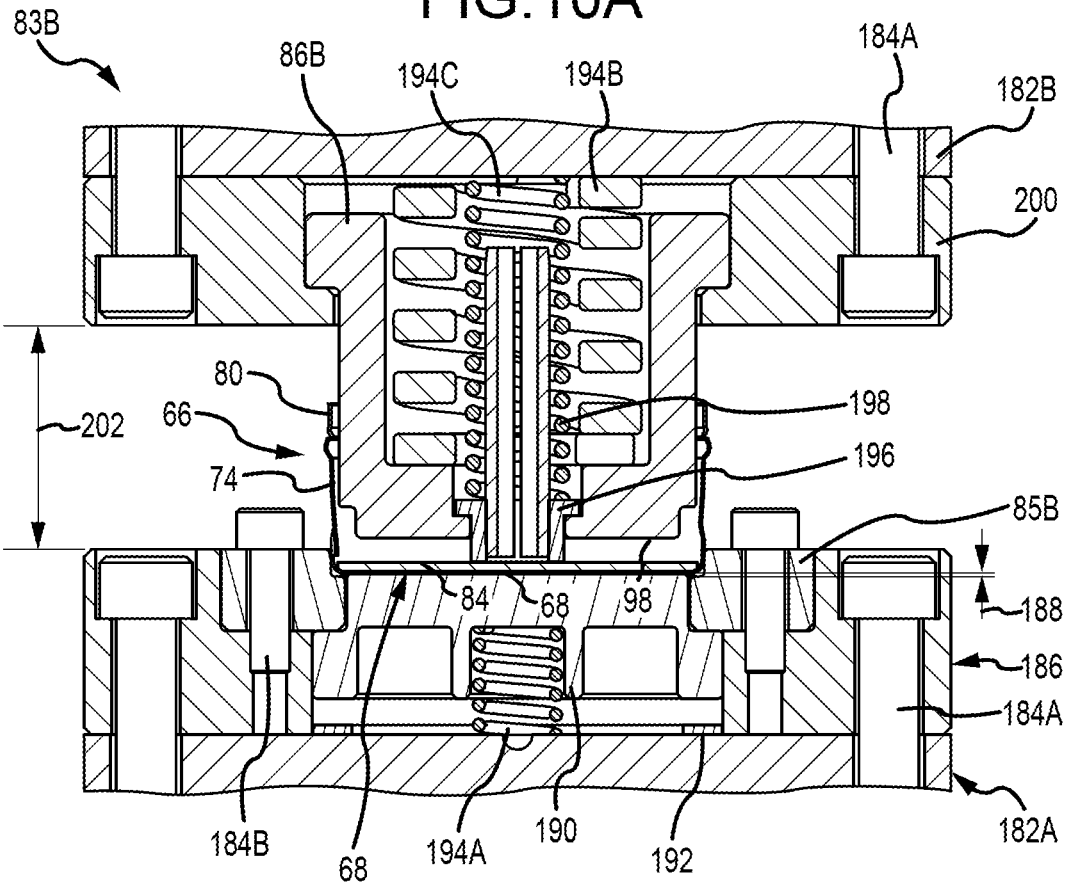
FIG. 10B is an expanded cross-sectional front elevation view of a portion of the channel forming apparatus of FIG. 10A.

The body 88 has a height 91 that is greater than a height of a metallic closure 66. More specifically, when the inner tool 86B is positioned within the metallic closure, at least a portion of the body 88 can extend from an open end 78 of the metallic closure 66 as generally illustrated in FIGS. 10B, 10D. In one embodiment, the height 91 is at least approximately 0.8 inches. Optionally, the height 91 is less than approximately 1.1 inches.

Optionally, a flange 87 can extend outwardly from an end of the body 88. When present, the flange 87 can have an outer diameter 95 of at least approximately 1.40 inches and less than approximately 2.0 inches. Optionally, the outer diameter 95 of the flange is between approximately 1.70 inches and approximately 1.90 inches. In one embodiment, the flange 87 extends at least approximately 0.20 inches from the end of the body. The flange 87 can extend less than approximately 1.00 inch.

A projection 92 is formed at an end of the body 88 opposite the flange 87. The projection 92 can have the same geometry and dimensions as the projection 92 of the inner tool 86A. The projection 92 of the inner tool 86B is generally defined by an end or shoulder 89 of the body 88, a sidewall 93 extending from the shoulder 89, and an end-wall 98. The end-wall 98 can be substantially planar.

The projection 92 has a predetermined exterior diameter 94 that is less than the exterior diameter 90 of the body 88. The exterior diameter 94 is less than a closed end-wall 68 of a metallic closure 66. Accordingly, when the inner tool 86B is positioned within the metallic closure 66, the end-wall 98 can apply a force to the closed end-wall 68 of the metallic closure 66 to draw or extend the closed end-wall 68 and form a channel 70 on the metallic closure. In one embodiment, the exterior diameter 94 of the projection 92 is at least approximately 1.25 inches. The exterior diameter 94 can be less than approximately 1.43 inches. Optionally, the exterior diameter 94 is between approximately 1.300 inches and approximately 1.310 inches.

The projection 92 extends a predetermined distance or height 96 from the body 88. The height 96 optionally is at least approximately 0.060 inches. In one embodiment, the height 96 is less than approximately 0.15 inches. The height 96 can optionally be between approximately 0.11 inches and approximately 0.14 inches.

Optionally, a radius of curvature R2 of a predetermined magnitude can be formed between the sidewall 93 and the end-wall 98. The radius of curvature R2 can be between approximately 0.015 inches and approximately 0.025 inches. Another radius of curvature R6 can be formed between the sidewall 93 and the shoulder 89. In one embodiment, the radius of curvature R6 is between approximately 0.01 inches and approximately 0.03 inches.

The inner tool 86B can also include a radius of curvature R3 formed between the shoulder 89 and the body portion 88. The radius of curvature R3 can be less than approximately 0.03 inches. In one embodiment, the radius of curvature R3 is greater than approximately 0.003 inches. Additionally, or alternatively, the radius of curvature R3 can be between approximately 0.003 inches and approximately 0.020 inches.

In one embodiment, the inner tool 86B is generally hollow. More specifically, one or more of a first cavity 170, a second cavity 172, and an aperture 174 can optionally be formed in the body 88. A first shoulder can be formed between the first cavity 170 and the second cavity 172. Optionally, a second shoulder is formed between the second cavity 172 and the aperture 174. In one embodiment, the first cavity 170 has an interior diameter of between approximately 0.80 inches and approximately 1.20 inches. The optional second cavity 172 may have an interior diameter of between approximately 0.4 inches and approximately 0.8 inches. The aperture 174 can optionally have an interior diameter of between approximately 0.37 inches and approximately 0.40 inches. In one embodiment, one or both edges of an interior sidewall of the aperture have a radius of curvature of approximately 0.2 inches.

Referring now to FIG. 10, a channel forming apparatus 83B of one embodiment of the present disclosure is generally illustrated. The channel forming apparatus 83B is similar to the channel forming apparatus 83A described herein and operates in the same or similar manner. More specifically, the channel forming apparatus 83B is operable to form a channel 70 in a metallic closure 66 using an outer tool 85 and an inner tool 86 of embodiments of the present disclosure. The channel forming apparatus 83B is illustrated in FIGS. 10A, 10B in a first position before the channel 70 is formed in the metallic closure 66. In FIGS. 10C, 10D, the channel forming apparatus 83B is show in a second position after forming the channel 70.

The channel forming apparatus 83B generally includes die sets spaced apart by a stop block 180. In the first position, illustrated in FIG. 10A, the die sets can be separated by a distance 181 of at least approximately 4.0 inches. In one embodiment, when the apparatus is in the first position, the distance 181 can be between approximately 4.20 inches to approximately 4.30 inches.

Referring now to FIG. 10B, the channel forming apparatus 83B includes tooling to support the outer tool 85B in a predetermined orientation with respect to the inner tool 86B. The outer tool 85B and the inner tool 86B can be interconnected to opposing spacers 182A, 182B of the channel forming apparatus 83B. In one embodiment, the outer tool 85B and the inner tool 86B are approximately coaxially aligned.

The outer tool 85B can be interconnected to an outer tool retainer 186 and the spacer 182A by one or more fasteners 184, such as screws or bolts. In one embodiment, the outer tool 85B is substantially immovably interconnected to the outer tool retainer 186.

An ejector 190 can optionally be associated with the spacer 182A. The ejection 190 can be aligned substantially coaxially with the outer tool 85B. A boss of the ejector 190 can project a predetermined distance into the aperture 100 of the outer tool 85B. The ejector 190 may include a flange configured to engage the outer tool 85B. A biasing element 194A can be positioned between the ejector 190 and the spacer 182A. The biasing element 194A optionally is a compression spring. Accordingly, in one embodiment, the ejector 190 is movable with respect to the spacer 182 and the outer tool 85B. Optionally, a shim 192 can be positioned between the ejector 190 and the spacer 182A.

When the channel forming apparatus 83B is in the first position, an exterior surface of the closed end wall 68 of the metallic closure 66 can contact the ejector 190. The ejector 190 may thus support the closed end wall 68 as a channel is formed. In the first position, when the closed end-wall 68 contacts the ejector 190, the closed end-wall 68 is spaced a predetermined distance 188 from the shoulder 156 of the outer tool 85B. Optionally, the distance 188 is greater than 0.001 inches less than approximately 0.040 inches. Additionally, in the first position the ejector 190 can be separated from the spacer 182A by a predetermined distance.

The inner tool 86B can optionally be moveably interconnected to the spacer 182B of the channel forming apparatus 83B. More specifically, the inner tool 86B can be retained in a predetermined orientation with respect to the spacer 182B by an inner tool retainer 200 and a fastener 184A. In the first position, the inner tool 86B is separated from the spacer 182B by a predetermined distance.

In one embodiment, a biasing element 194B is positioned between the inner tool 86B and the spacer 182B. The biasing element 194B can be a die spring with a medium load. In one embodiment, biasing element 194B is positioned within a first cavity 170 of the inner tool 86B. The biasing element 194B can engage a shoulder formed between a first cavity and a second cavity of the inner tool 86B.

Optionally, another biasing element 194C, such as a compression spring, can optionally be positioned within the biasing element 194B. The biasing element 194C is configured to apply a force to a flanged sleeve bearing 196 that, in one embodiment, is associated with the inner tool 86B. A guide element 198, such as a slotted spring pin, can be positioned within the biasing element 194C. The guide element 198 can extend from an aperture of the flanged sleeve bearing 196.

In one embodiment, when the channel forming apparatus 83 is in the first position, the biasing element 194B can apply a force to the flanged sleeve bearing 196 such that an end of the flanged sleeve bearing 196 extends beyond the end-wall 98 of the inner tool 86B. The end of the flanged sleeve bearing 196 can contact a liner 84 within the metallic closure 66. Accordingly, in one embodiment, the inner tool 86B can be spaced from the liner 84 when the apparatus 83B is in the first position. In one embodiment, when in the first position, the outer tool retainer 186 is spaced from the inner tool retainer 200 by a distance 202 that is greater than approximately 0.7 inches but less than approximately 1.1 inches.

Figure 10C:
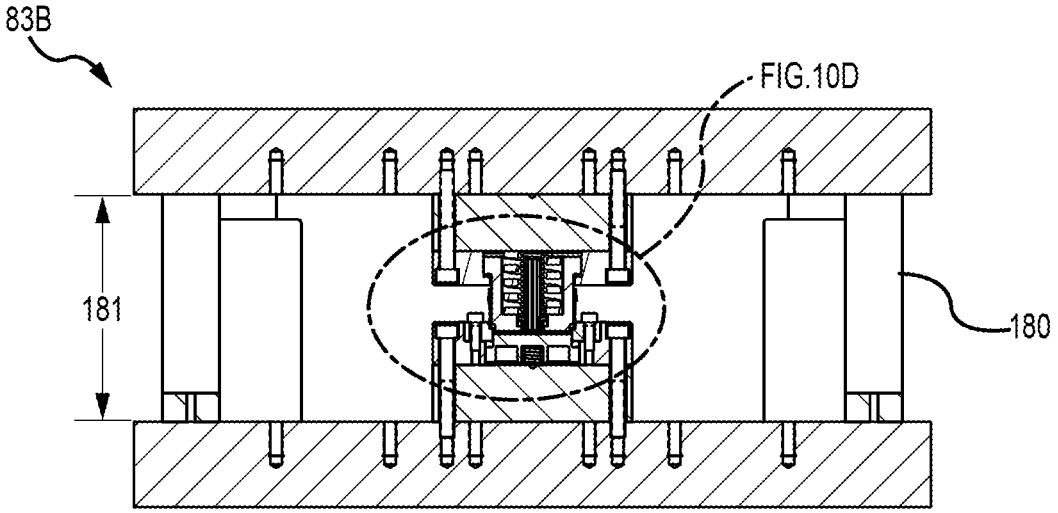
FIG. 10C is a cross-sectional front elevation view of the channel forming apparatus of FIG. 10A illustrated in a second position during the formation of the channel in the metallic closure.
Figure 10D:
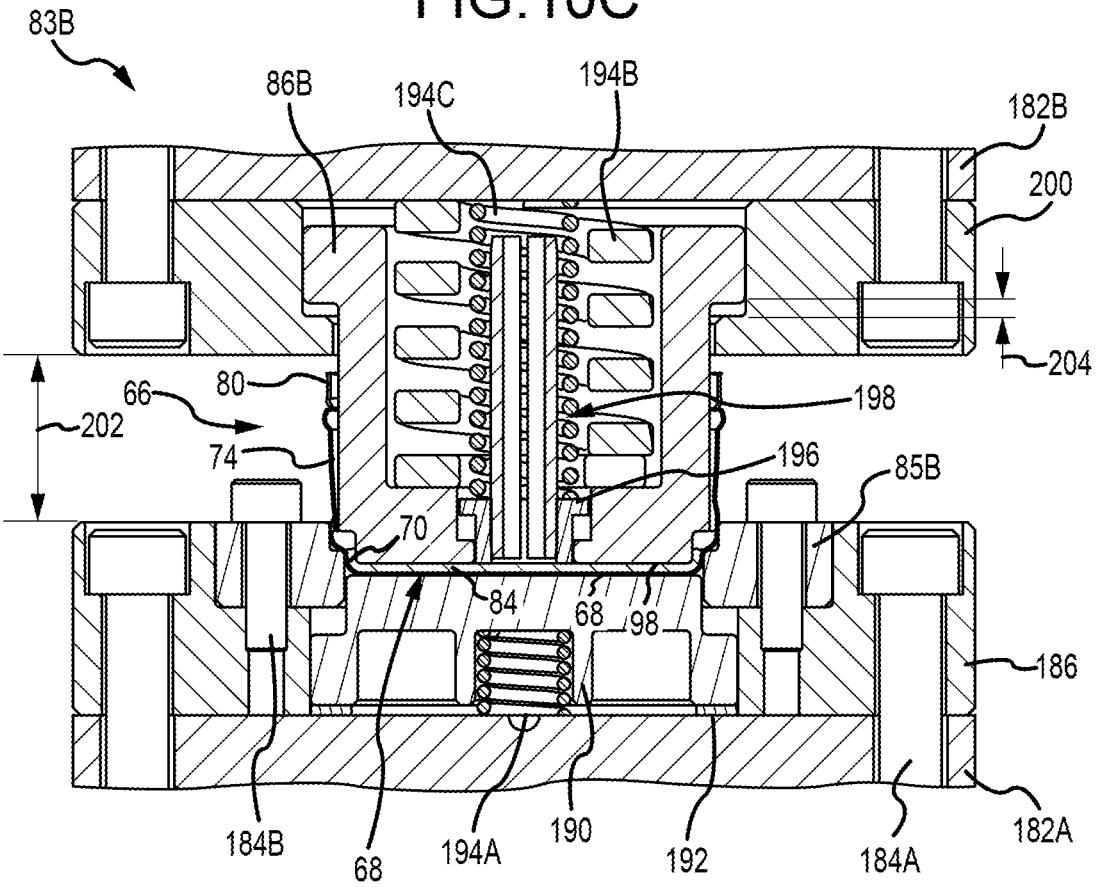
FIG. 10D is another cross-sectional front elevation view of the channel forming apparatus of FIG. 10C.

Referring now to FIGS. 10C, 10D, the channel forming apparatus 83B is configured to move one or more of the outer tool 85B and the outer tool 86B together to draw or extend the closure end-wall 68 to form the channel 70. In the second position, generally illustrated in FIG. 10C, the die sets of the channel forming apparatus 83B can be separated by a distance 181 of less than approximately 4.2 inches. In one embodiment, as one or more of the die sets move from the first position to the second position, the distance 181 decreases by between approximately 0.10 inches to approximately 0.40 inches. Optionally, in the second position, the outer tool retainer 186 is spaced from the inner tool retainer 200 by a distance 202 that is greater than approximately 0.40 inches but less than approximately 0.90 inches.

The end-wall 98 of the inner tool 86B distributes the forming load applied to the metallic closure 66 substantially evenly to the entire closed end-wall 68. In this manner, the material of the metallic closure 66 is not thinned unevenly when the inner tool 86B forms the channel 70. Additionally, the large surface of the end-wall 98 compresses the liner 84 which can subsequently return to its original shape and thickness when the inner tool 86 is removed.

Figure 8D:
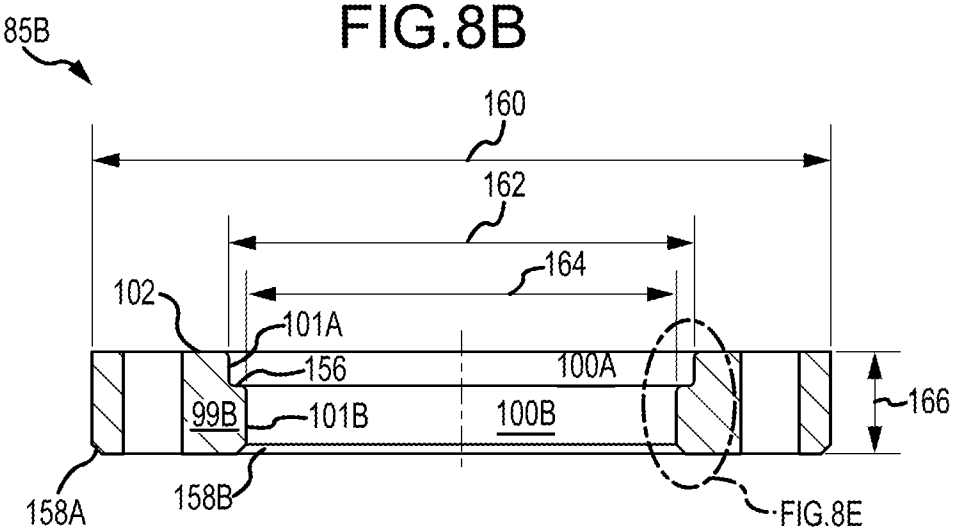
FIG. 8D is a cross-sectional front elevation view of the outer tool taken along line 8D-8D of FIG. 8B.

As generally illustrated in FIG. 10D, in the second position at least a portion of the closed end-wall 68 is within the portion of the cavity 100 of the outer tool with the interior diameter 164 defined by the second interior sidewall 101B (illustrated in FIG. 8D). The ejector 190 can move closer to the spacer 182A and the inner tool 86B may move toward the spacer 182B. In one embodiment, a flange 87 of the inner tool 86B is separated from an opposing flange of the inner tool retainer 200 by a predetermined distance 204 when the channel forming apparatus 83B is in the second position. The distance 204 can be between approximately 0.03 inches and 0.1 inch.

The channel forming apparatus 83B can apply a force of up to approximately 425 pounds to the metallic closure 66 to form the channel 70. Optionally, the tools 85B, 86B apply between approximately 75 pounds and approximately 425 pounds to the metallic closure when the channel 70 is formed.

After the channel 70 is formed, the channel forming apparatus 83B moves one or more of the spacers 182A, 182B such that the outer tool 85B and inner tool 86B are separated. The metallic closure 66 with the preformed channel 70 is then ejected from the channel forming apparatus 83B. Another metallic closure 66 can subsequently be positioned on the inner tool 86B as generally illustrated in FIG. 10B.

Figure 11A:
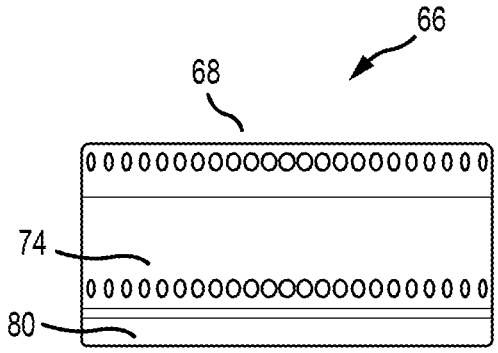
FIGS. 11A-11B are a front elevation view and a bottom perspective view of a metallic closure of an embodiment of the present disclosure before threads and a channel are formed in a body portion of the metallic closure.
Figure 11B:
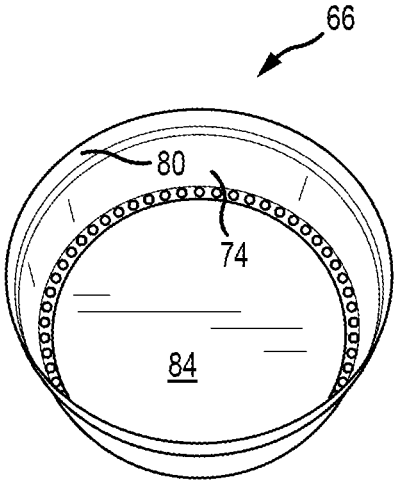
Figure 11C:
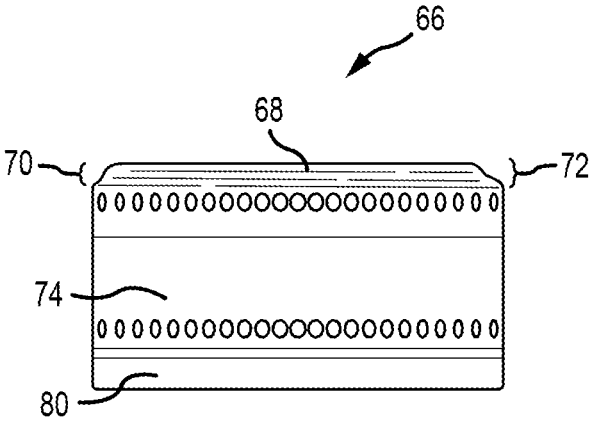
FIGS. 11C-11D are another front elevation view and another bottom perspective view of the metallic closure of FIG. 10 after a channel has been formed thereon.
Figure 11D:
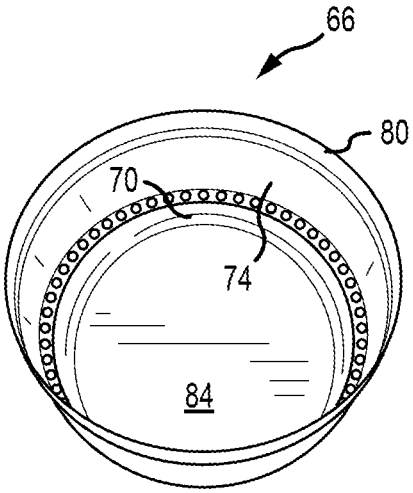
Figure 12:
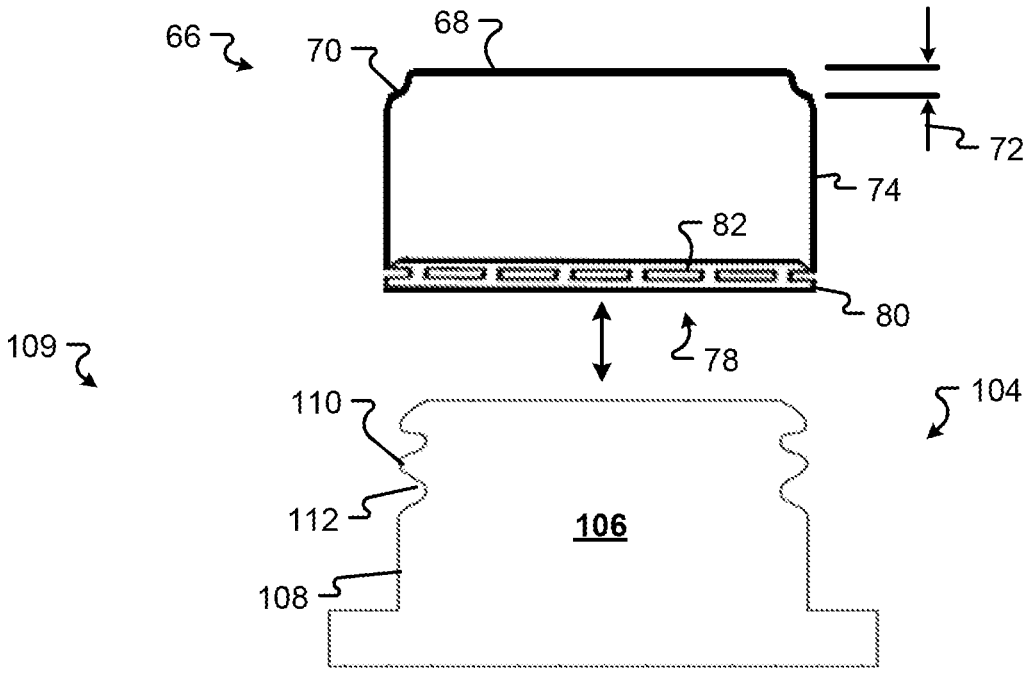
FIGS. 12-13 are schematic illustrations of a mandrel of an apparatus of one embodiment of the present disclosure configured to form threads on a body portion of a metallic closure.

Referring now to FIGS. 11A-11D, illustrations of a metallic closure 66 of one embodiment of the present disclosure are provided. FIGS. 11A-11B show the metallic closure 66 before a channel 70 and threads 76 are formed. FIGS. 11C-11D illustrate the metallic closure 66 after tools 85, 86 of a channel forming apparatus 83 of one embodiment of the present disclosure have formed a channel 70 as described herein. In one embodiment, the body portion 74 of the metallic closure is extended to form the channel 70. More specifically, in FIG. 11A, the closed end-wall 68 of the metallic closure is a predetermined distance from the pilfer band 80. When the channel 70 is formed, the closed end-wall 68 is moved from the pilfer band 80 by a distance approximately equal to a height 72 of the channel 70 as generally illustrated in FIG. 11C.

Returning to FIG. 6, optionally in operation 58, a liner 84 can be placed in the metallic closure 66 after the channel 70 is formed. More specifically, in one embodiment of method 50, the liner 84 is positioned in the metallic closure 66 in one of operation 54 and operation 58.

In optional operation 60, closure threads 76 can be formed on the closure body 74. More specifically, and referring now to FIG. 12, a thread forming apparatus 109 with a threaded mandrel 104 of one embodiment of the present disclosure is generally illustrated. The threaded mandrel 104 is configured to form threads 76 on the closure body 74. The threaded mandrel 104 has a mandrel body 106 which is generally cylindrical. The mandrel body 106 is configured to fit within a metallic closure 66. In one embodiment, the threaded mandrel 104 is configured to move toward the metallic closure 66 until the mandrel body 106 is in a predetermined alignment within the metallic closure. Additionally, or alternatively, the metallic closure 66 can be moved toward the mandrel body 106.

A sidewall portion 108 of the mandrel body 106 has a profile shaped to guide a tool 114 and form the closure threads 76. In one embodiment, the sidewall portion 108 includes projections 110 and depressions 112 that are shaped to form one or more threads 76 in a metallic closure 66. The depressions 112 can optionally have a geometry to form a closure thread 76 with a depth of between approximately 0.01 inches and approximately 0.03 inches. In one embodiment, the depressions 112 have a geometry to partially form the closure thread 76. More specifically, the threaded mandrel 104 is configured to partially form a closure thread which is subsequently altered when the metallic closure 66 is used to seal a metallic bottle. Accordingly, in one embodiment, the depressions 112 have a geometry to partially form a closure thread 76 with a depth of at least approximately 0.005 inches and less than approximately 0.03 inches.

Optionally, the threaded mandrel 104 can include the channel forming geometry of the inner tools 86 of the present disclosure. More specifically, the mandrel body 106 can include the projection 92 and other features that are the same as, or similar to, those of the inner tool 86. In this manner, the threaded mandrel 104 can optionally be used to form the channel 70 in addition to forming the closure threads 76 of the metallic closure 66.

Figure 13:
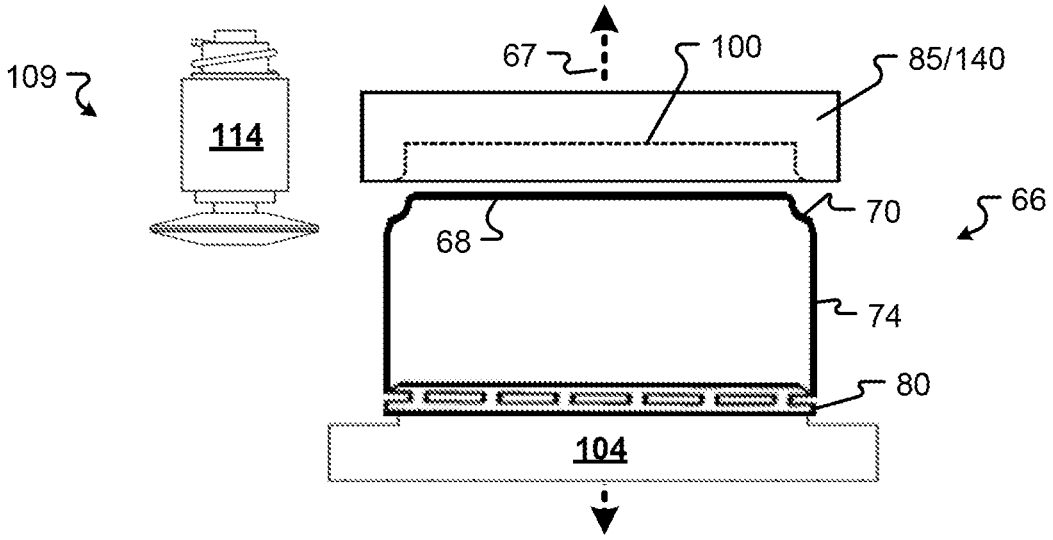

Referring now to FIG. 13, when the metallic closure 66 is positioned on the threaded mandrel 104, a tool 114 of the thread forming apparatus 109 applies a side-load force to the closure body 74. The tool 114 can optionally be a thread roller. The thread roller or tool 114 uses the underlying threaded mandrel 104 as a guide to form the closure threads 76. The closure threads 76 are formed as the tool 114 presses against and winds axially around the closure body portion 74 along the thread depressions 112 of the threaded mandrel 104. The tool 114 generally embosses the shape of the closure threads 76 on the closure body 74. Optionally, the tool 114 can make one or more passes to form the closure threads. During each pass, the tool 114 can make between approximately 1.5 and approximately 2 revolutions around the closure body portion 74. The tool 114 does not apply a side-load to the optional pilfer band 80 (when present). Although only one tool or thread roller is illustrated with the thread forming apparatus 109, two or more tools 114 can be used to form the closure threads 74. One or more operations can be used to fully form the threads 76 onto the closure 66. In one embodiment, the tool 114 forms the threads 76 in two or more passes.

In one embodiment, the tool 114 applies a side-load of at least approximately 20 pounds to a metallic closure 66 when forming closure threads 76. In another embodiment, the tool 114 applies a side-load of at least approximately 26 pounds when forming closure threads. In yet another embodiment, a side-load of at least approximately 30 pounds is applied to a metallic closure by tool 114, such as a thread roller, when forming closure threads 76. Optionally the side-load applied by the tool 114 is between approximately 20 pounds and approximately 40 pounds to form the closure threads. In another embodiment, the tool 114 applies approximately the same amount of side-load as the prior art thread roller 26. In another embodiment, the tool 114 applies at least approximately 116 percent more side-load than the prior art thread roller 26. In still another embodiment, the tool 114 applies more than approximately 132 percent side-load than the prior art thread roller 26 when forming closure threads.

Figure 2:
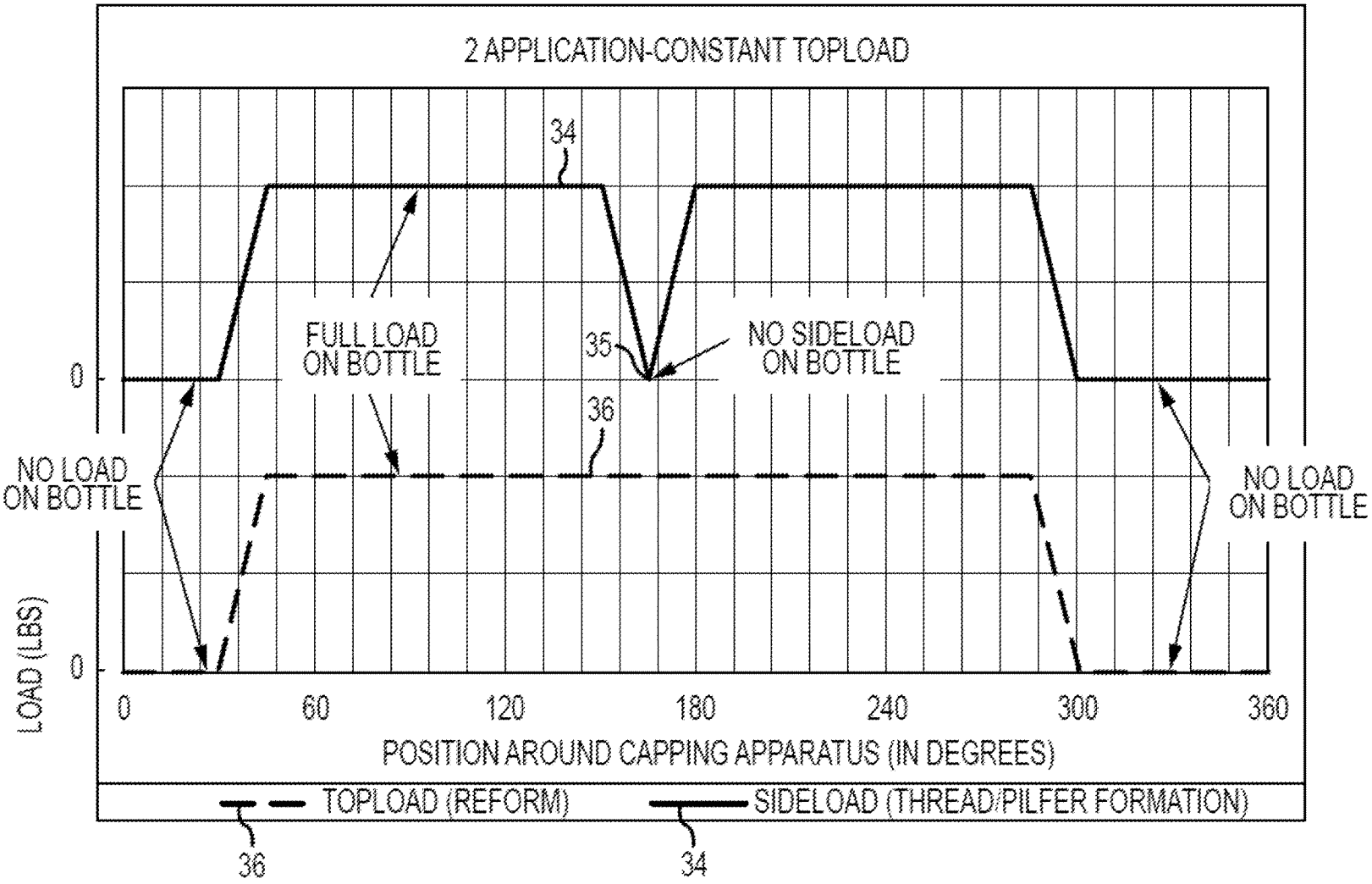
Fig. 2 (Prior Art)
FIG. 2 is a graph of forces applied to a metallic bottle during sealing of the metallic bottle with a ROPP closure using a prior art capping apparatus.
Figure 3:
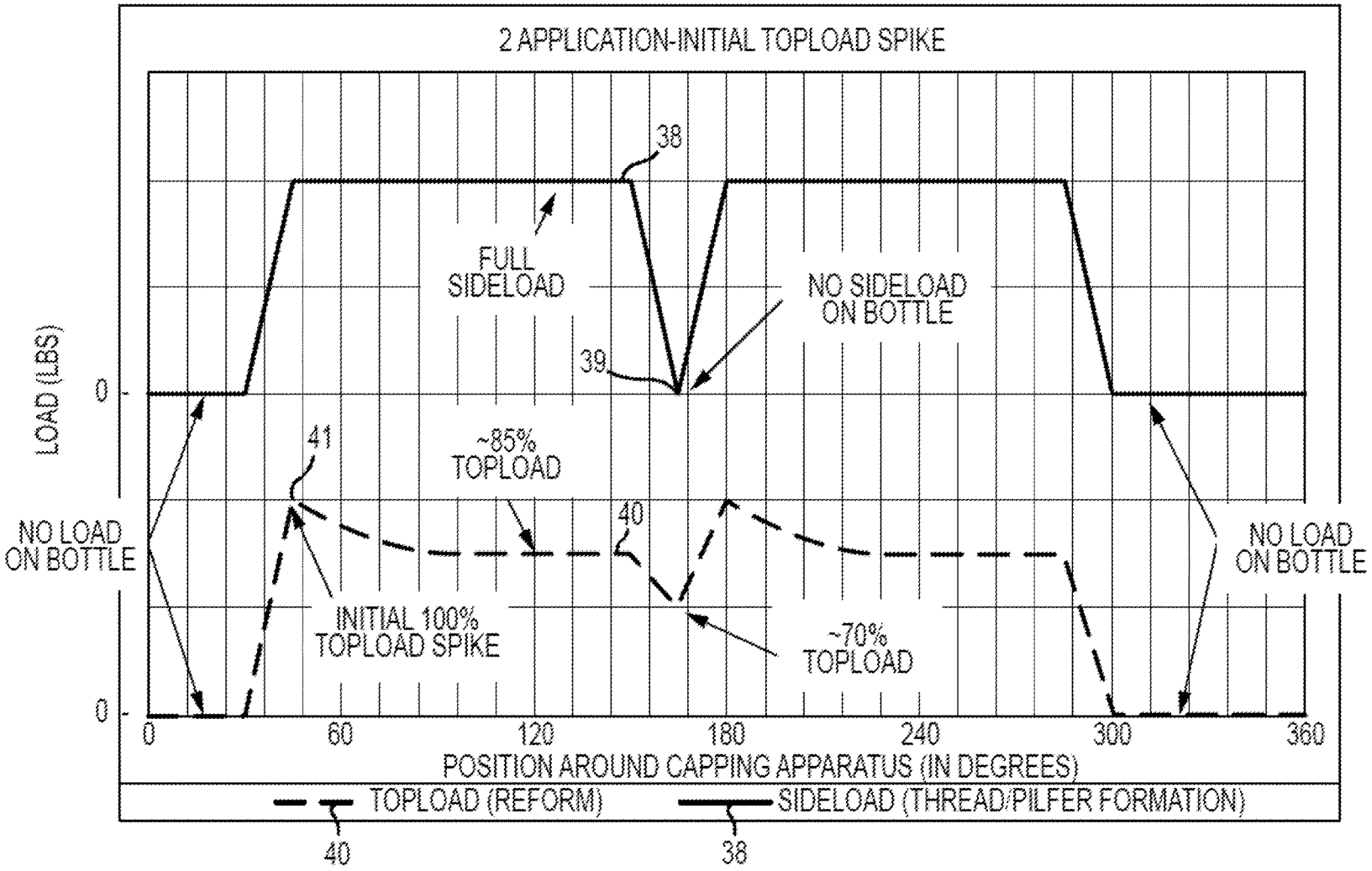
Fig. 3 (Prior Art)
FIG. 3 is another graph of forces applied by another prior art capping apparatus to a metallic bottle when the metallic bottle is sealed with a ROPP closure.

In one embodiment, the closure threads 76 are only partially formed while the metallic closure 66 is positioned on the threaded mandrel 104. The threads 76 can be further formed by a tool 114 of a capping apparatus 138 of the present disclosure. In this manner, the side-load force applied by the capping apparatus 138 is reduced compared to the prior art capping apparatus 22. More specifically, the tool 114 can finish forming the threads 76 while applying less side-load force than the prior art thread roller 26. In one embodiment, by forming closure threads 76 on the metallic closure 66 before the metallic closure is positioned on a metallic bottle 116, the magnitude of side-load applied by a capping apparatus to seal the metallic bottle is substantially reduced. For example, some or all of the side-load forces illustrated in FIGS. 2-3 can be eliminated. In one embodiment, by pre-forming the closure threads 76 on the metallic closure, the side-load applied by a capping apparatus to a metallic bottle 116 is reduced by at least 40 pounds.

After the closure threads 76 are formed, the metallic closure 66 is removed from the threaded mandrel 104. In one embodiment, at least one of the metallic closure 66 and the threaded mandrel 104 rotate in opposite, opening directions such that the metallic closure 66 is unthreaded from the thread depressions 112 of the threaded mandrel. Optionally, the mandrel 104 can be made to be collapsible so as to be removed from the metallic closure 66 after the closure threads 76 have been formed.

The thread forming apparatus 109 can optionally include a chuck 140. In one embodiment, the chuck operates to align the metallic closure 66 with the threaded mandrel 104. Optionally, the chuck 140 is similar to the outer tools 85 of the present disclosure. More specifically, in one embodiment the chuck 140 includes a recess 100. The recess 100 can be the same as or similar to the recess 100 of the outer tools 85A, 85B described in conjunction with FIG. 8. Accordingly, the chuck 140, in one embodiment, is configured to form a channel 70 in the metallic closure in cooperation with the threaded mandrel 104. At least a portion of the recess 100 has an interior diameter that is less than an exterior diameter of the closed end-wall 68. Optionally, in another embodiment, another portion of the recess 100 has an interior diameter at least equal to the exterior diameter of the closed end-wall 68. In one embodiment, the chuck 85/140 does not alter the channel 70 of the metallic closure 66.

In one embodiment, one or more of the chuck 140 and the outer tool 85 can rotate around a longitudinal axis 67 of the metallic closure 66. In this manner, after the thread forming apparatus 109 forms the closure threads 76, one or more of the threaded mandrel 104 and the chuck 140/85 can rotate in an opening direction to separate the threaded metallic closure 66 from the threaded mandrel 104.

Figure 14:
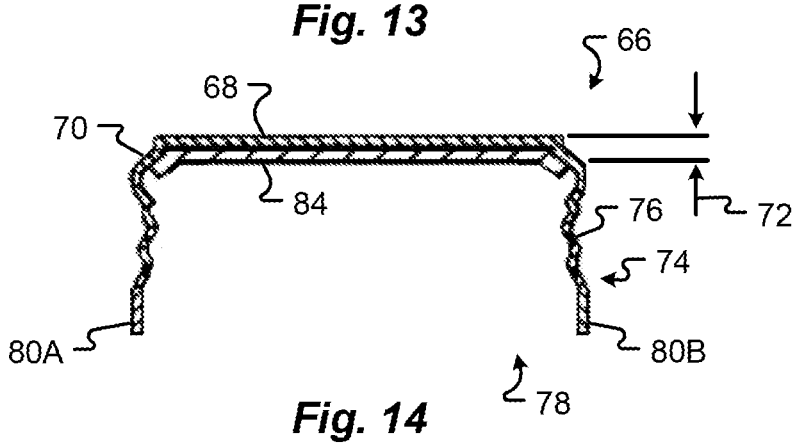
FIG. 14 is a cross-sectional front elevation view of a metallic closure of the present disclosure including a channel and pre-formed threads.

Referring now to FIG. 14, a metallic closure 66 according to one embodiment of the present disclosure is generally illustrated. The metallic closure 66 includes one or more of a channel 70 and, optionally, closure threads 76 formed as described herein before the metallic closure 66 is positioned on a metallic bottle 116. The optional pilfer band 80 has a cross-sectional shape that remains generally cylindrical to fit over a pilfer skirt 126 of a metallic bottle 116. More specifically, in the cross-section of FIG. 14, a left portion 80A of the pilfer band is substantially parallel to a right portion 80B of the pilfer band.

Referring again to FIG. 6, after at least one of a channel 70 and threads 76 are formed on the metallic closure 66, the metallic closure can be used to seal a metallic bottle 116. In operation 62, the metallic closure 66 is aligned with a threaded neck 124 of a metallic bottle 116. In operation 64, a capping apparatus 138 of one embodiment of the present disclosure interconnects the metallic closure 66 to the metallic bottle 116. More specifically, in one embodiment, the capping apparatus 138 can screw the metallic closure 66 onto the threaded neck 124 of the metallic bottle 116. Optionally, in another embodiment, the capping apparatus 138 positions the metallic closure 66 on the threaded neck of the metallic bottle 116 and subsequently forms threads 76 on the metallic closure 66.

Figure 15:
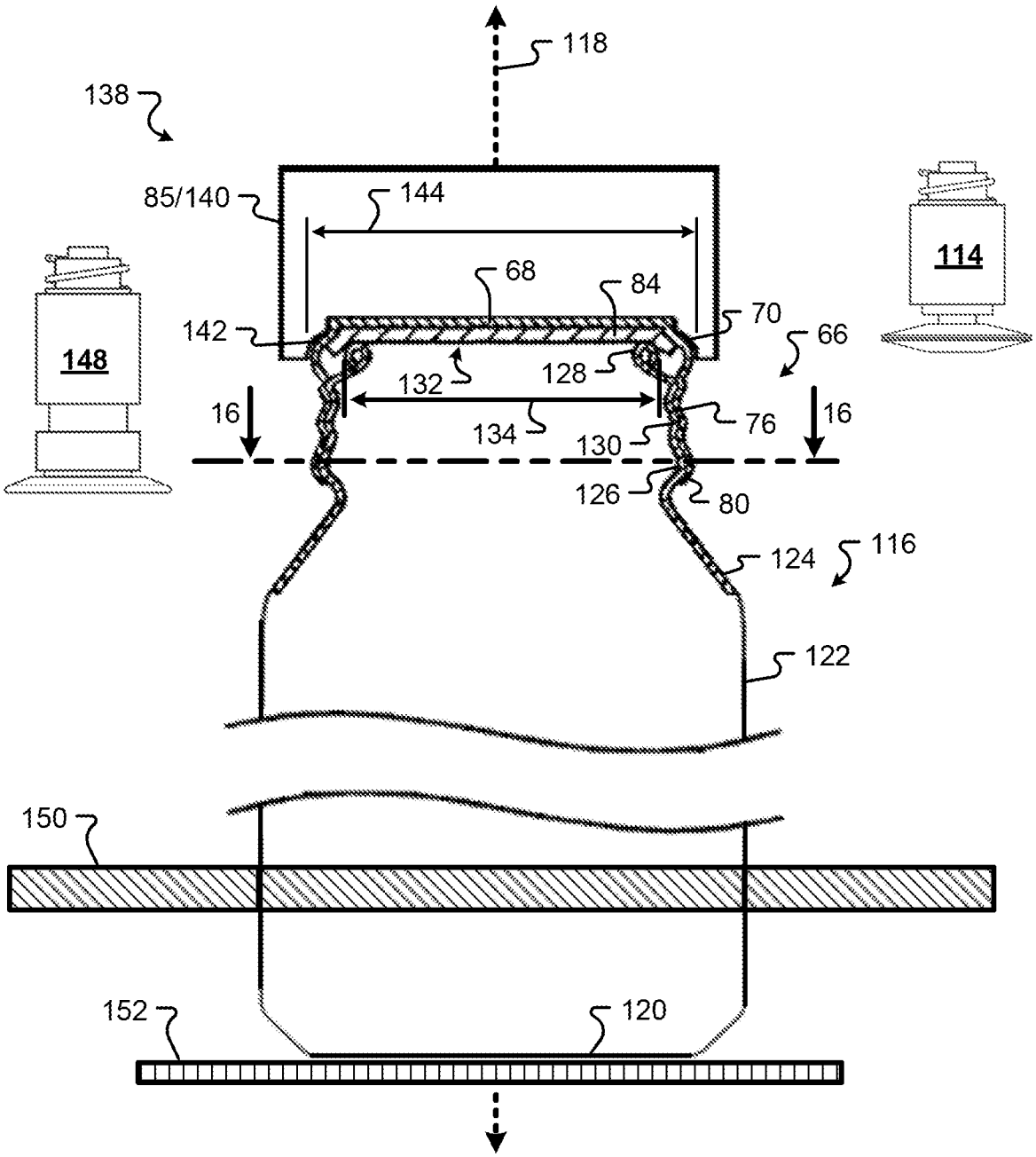
FIG. 15 is a partial front elevation view of a capping apparatus of one embodiment of the present disclosure and depicting the neck of a metallic bottle sealed with a metallic closure by the capping apparatus.

Referring now to FIG. 15, a capping apparatus 138 of one embodiment of the present disclosure that is operable to seal a metallic bottle 116 with a metallic closure 66 is generally illustrated. The metallic bottle 116 generally includes one or more of a closed end portion 120, a body portion 122 extending from the closed end portion 120, a neck portion 124 with a reduced diameter, an optional skirt 126 extending outwardly on the neck portion 124, a curl 128 at an uppermost portion of the neck portion 124, threads 130 generally positioned between the skirt 126 and the curl 128, and an opening 132 positioned at an uppermost portion of the neck portion 124.

The body portion 122 of the metallic bottle 116 can have any desired size or shape. For example, in one embodiment, the body portion 122 has a generally cylindrical shape. The bottom portion 120 can include an inward dome. The body portion 122 can optionally include a waist portion with a reduced diameter. In one embodiment, the waist portion includes an inwardly tapered cross-sectional profile. In another embodiment, the body portion 122 of the metallic bottle 116 has a diameter of between approximately 2.5 inches and approximately 2.85 inches. In yet another embodiment, the metallic bottle 116 has a height of between approximately 3.0 inches and approximately 11 inches or between approximately 6.0 inches and approximately 7.4 inches.

The metallic bottle 116 can include any number of threads 130 (including a single thread) that each have a predetermined size, shape, and pitch. The threads 130 can be integrally formed on the neck portion 124. Alternatively, the threads 130 can be formed on an outsert that is interconnected to the neck portion 124 as described in U.S. Patent Application Publication No. 2014/0263150 which is incorporated herein in its entirety by reference. Other methods and apparatus used to form threads on metallic bottles are described in U.S. Patent Application Publication No. 2012/0269602, U.S. Patent Application Publication No. 2010/0065528, U.S. Patent Application Publication No. 2010/0326946, U.S. Pat. Nos. 8,132,439, 8,091,402, 8,037,734, 8,037,728, 7,798,357, 7,905,130, 7,555,927, 7,824,750, 7,171,840, 7,147,123, 6,959,830, 5,704,240, and International Application No. PCT/JP2010/072688 (publication number WO/2011/078057), which are all incorporated herein in their entirety by reference.

In one embodiment, the metallic bottle 116 is the same as, or similar to, the prior art metallic bottle 2. Optionally, the metallic bottle 116 can be formed of a recycled aluminum alloy such as described in U.S. Pat. No. 9,517,498 which is incorporated herein by reference in its entirety. In another embodiment, the metallic bottle 116 is a light-weight metallic bottle formed of at least one of less, lighter, and different metallic material than the prior art metallic bottle 2. In one embodiment, at least a portion of the light-weight metallic bottle 116 is at least approximately 5% thinner than a similar portion of a prior art metallic bottle 2. In another embodiment, the column strength of the light-weight metallic bottle 116 is at least approximately 8% less than the column strength of the prior art metallic bottle 2. In yet another embodiment, the alloy used to form the light-weight metallic bottle 116 has a column strength that is at least approximately 15% less than the column strength of the alloy used to form the prior art metallic bottle 2. In one embodiment, the light-weight metallic bottle 116 has a mass of less than approximately 0.820 oz. In another embodiment, the mass of the light-weight metallic bottle 116 is less than approximately 0.728 oz. In still another embodiment, the metallic bottle 116 has a thickness of less than approximately 0.0092 inches. In one embodiment, the thickness is between approximately 0.0040 inches and approximately 0.0095 inches.

The capping apparatus 138 generally includes a chuck 140 and a pilfer roller 148. In one embodiment, the chuck 140 is similar to the outer tool 85. Optionally, in another embodiment, an outer tool 85 of the present disclosure is used with the capping apparatus 138 in place of the chuck 140. Optionally, the capping apparatus 138 can further include one or more of a holder 150 and a bottom chuck 152 to engage a metallic bottle 116.

The chuck 140 is configured to align a metallic closure 66 with a metallic bottle 116. In one embodiment, the chuck 140 includes a recess 142 configured to engage the metallic closure 66. The recess 142 has an interior diameter 144 at least equal to an outer diameter of the metallic closure. In one embodiment, the interior diameter 144 is between approximately 1.31 inches and approximately 1.4 inches. Optionally, the interior diameter 144 is between approximately 1.312 inches and approximately 1.323 inches. In one embodiment, the chuck 140 does not alter the channel 70 of the metallic closure 66. More specifically, during sealing of a metallic bottle 116, the capping apparatus 138 of one embodiment of the present disclosure does not alter the geometry or depth 72 of the channel 70.

In one embodiment, at least one of the chuck 140 and the outer tool 85 can rotate around a longitudinal axis 118 of the metallic bottle 116. In this manner, the chuck 140 can screw the metallic closure 66 onto the bottle threads 130 when the closure threads 76 are pre-formed (or partially pre-formed) on the metallic closure 66. Additionally, or alternatively, one or more of the holder 150 and the bottom chuck 152 can rotate the metallic bottle 116 around the bottle axis 118. Thus, the metallic bottle 116 can be screwed into the metallic closure 66 by the capping apparatus 138. More specifically, and referring now to FIG. 16, one or more of the metallic bottle 116 and the pre-threaded metallic closure 66 can be rotated in a respective closing direction 146, 154, around the bottle axis 118 to screw the metallic closure and the metallic bottle together.

Referring again to FIG. 15, as the metallic closure and/or the metallic bottle 116 are screwed together, the bottle curl 128 is driven into the liner 84 to at least partially compress the liner to form and maintain a seal between the metallic closure 66 and the metallic bottle 116. More specifically, the bottle curl 128 is at least partially embedded in the closure liner 84 by the rotation of one or more of the metallic closure 66 and the metallic bottle together 116. Accordingly, the capping apparatus 138 of the present disclosure can seal a metallic bottle 116 with a metallic closure 66 while applying less of a top-load than the prior art capping apparatus 22. In one embodiment, the capping apparatus 138 applies at least approximately 40 percent less top-load to a metallic bottle 116 than the prior art capping apparatus 22. In another embodiment, capping apparatus 138 applies less than approximately 160 pounds of top-load. In still another embodiment, the capping apparatus 138 applies between approximately 60 pounds and approximately 160 pounds of top-load to a metallic bottle when sealing the metallic bottle with a metallic closure 66.

Optionally, one or more of the chuck 140, the holder 150, and the bottom chuck 152 can include a torque limiting device. In this manner, the metallic closure 66 can be screwed onto the metallic bottle 116 to a predetermined torque setting.

In one embodiment, when the metallic closure 66 does not include pre-formed threads, the chuck 140 positions the metallic closure 66 on the metallic bottle. The chuck 140 applies a top-load to drive the bottle curl 128 at least partially into the closure liner 84. An optional thread roller or other tool 114 of one embodiment of the capping apparatus 138 can then form closure threads 76 on the metallic closure 66 as described herein to interconnect the metallic closure to the metallic bottle 116.

After the capping apparatus 138 screws or otherwise interconnects the metallic closure 66 and metallic bottle 116 together, in one embodiment of the present disclosure, the optional pilfer roller 148 can tuck the pilfer band 80 against the bottle skirt 126. The pilfer roller 148 applies a side-load force to the metallic bottle 116 to tuck the optional pilfer band 80 against the bottle skirt 126. The pilfer roller 148 is illustrated in FIG. 15 in a disengaged position for clarity. Optionally, the capping apparatus 138 can include two or more pilfer rollers 148. Optionally, each pilfer roller 148 can make one or more rotations around the metallic bottle 116 during the tucking of the pilfer band 80.

Figure 17:
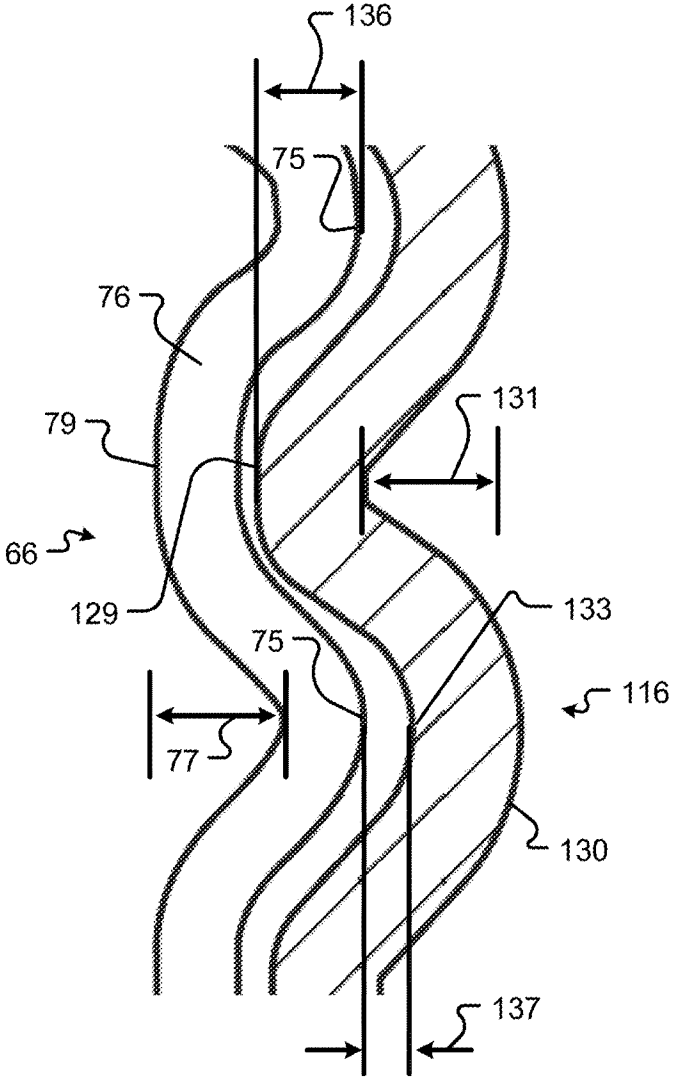
FIG. 17 is an expanded partial cross-sectional elevation view of the metallic bottle and metallic closure of FIG. 15 and illustrating the closure threads engaged to the bottle threads according to one embodiment of the present disclosure.
Figure 16:
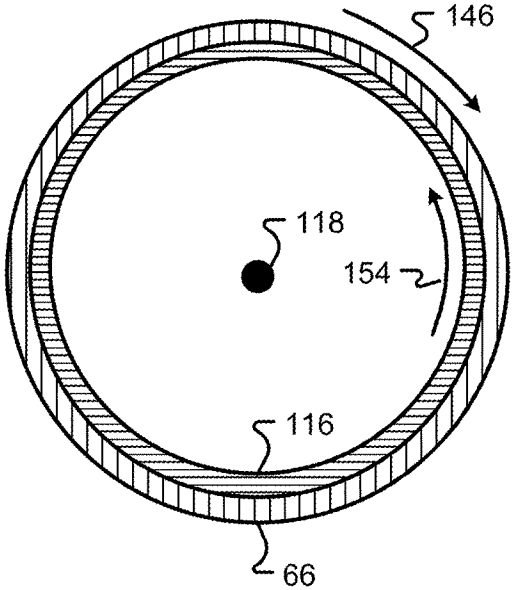
FIG. 16 is a cross-sectional top plan view of the metallic bottle and the metallic closure taken along line 16-16 of FIG. 15 and further illustrating rotation of one or more of the metallic bottle and the metallic closure in a closing direction during the sealing of the metallic bottle.

Referring now to FIG. 17, the bottle threads 130 generally include one or more peaks 129 (with a maximum exterior diameter) and valleys 133 having a minimum exterior diameter. The closure threads 76 include corresponding peaks 79 (a maximum exterior diameter) and valleys 75 (or minimum interior diameter). In one embodiment, the bottle threads 130 and the closure threads 76 are the same as, or similar to, the threads 8, 16 of the prior art metallic bottle 2 and ROPP closure 10.

Figure 18A:
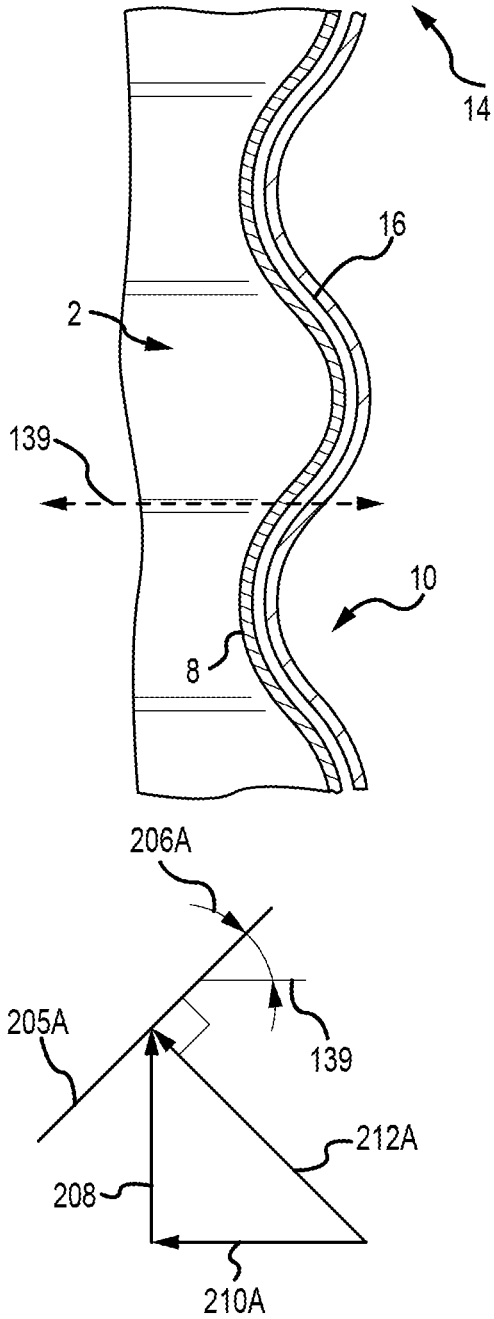
FIG. 18A illustrates forces acting on bottle threads and closure threads that have a shape that is generally symmetric.
Figure 18B:
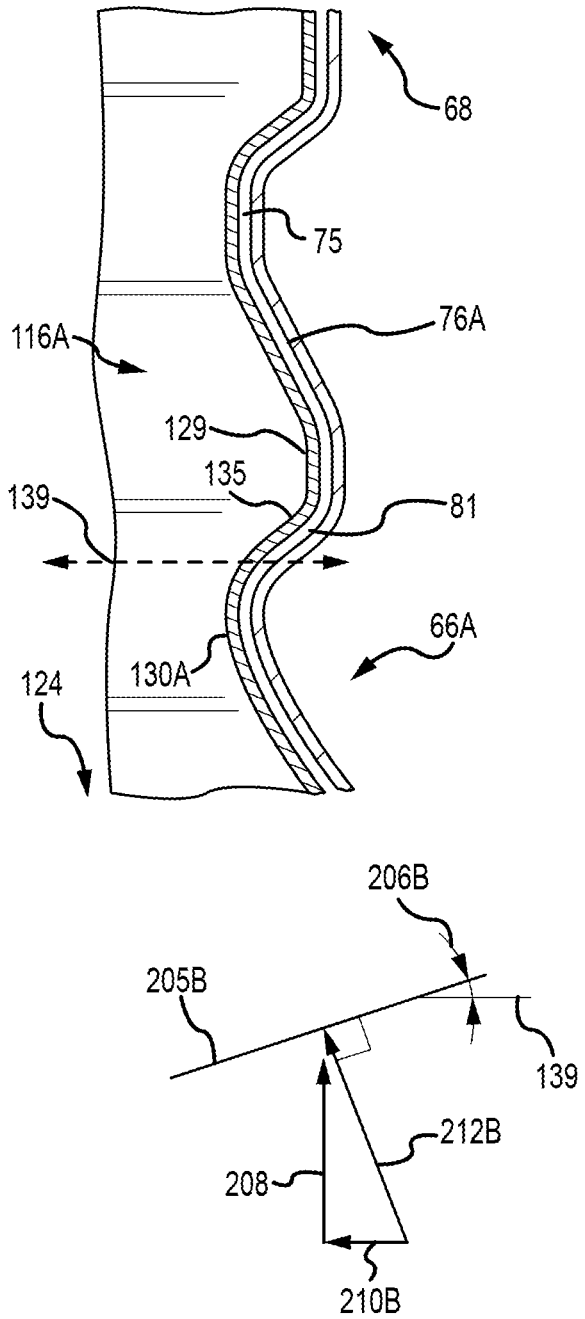
FIG. 18B illustrates forces acting on bottle threads and closure threads of an embodiment of the present disclosure that have a shape that is not symmetric and which include an overhung segment that is at a decreased angle relative to a horizontal plane than the threads illustrated in FIG. 18A.

Optionally, the threads 76, 130 of the metallic closure or the metallic bottle can have a different shape or geometry compared to the prior art closure threads 16 and bottle threads 8. Referring now to FIG. 18, in one embodiment the closure threads 76 and the bottle threads 130 are more overhung compared to the prior art closure threads 16 and bottle threads 8. For example, the bottle threads 130A of the portion of the metallic bottle 116A illustrated in FIG. 18B include a thread segment 135 that is at a decreased angle 206B to a horizontal plane 139 than the bottle threads 8 illustrated in FIG. 18A. The bottle threads 8 have a greater angle 206A from the horizontal plane 139 compared to the bottle threads 130A. In one embodiment, a closure thread 76A of the present disclosure is more horizontal than a prior art closure thread 16. Similarly, in one embodiment, the bottle thread 130A is more horizontal than a prior art bottle thread 10. In one embodiment, the closure thread 76A and the bottle thread 130A have a maximum angle 206B from a horizontal plane 139 of less than approximately 45 degrees. In another embodiment, the maximum angle 206B for the threads 76A, 130A is between approximately 15 degrees and approximately 60 degrees.

Overhanging the threads 76A, 130A improves engagement of the metallic closure 66A with the metallic bottle 116A. The overhung closure threads 76A have a stronger connection with the bottle threads 130A. Additionally, a metallic closure 66 with overhung threads 76 is more resistant to closure blow-off due to pressure within a metallic bottle 116. As illustrated in FIG. 18B, the pressure in the metallic bottle 116A creates a force 208 to lift the metallic closure 66A off of the metallic bottle. The bottle threads 130A provide an opposite force 212B to keep the metallic closure 66A on the metallic bottle 116A. If a point of contact between the bottle threads 130A and the closure threads 76A is more overhung (less vertical), such as at segments 135, 81, then the force 208 is in better alignment with the force of closure ejection 212B. For example, when the force 208 is constant, the angle between the force 208 and the force of closure ejection 212B illustrated in FIG. 18B is less than an angle between the force 208 and a force of closure ejection 212A for prior art bottle threads 8 and closure threads 16 illustrated in FIG. 18A. Therefore, a force 210B which can cause the metallic closure 66A to expand over the bottle threads 130A and blow off of the metallic bottle 116A is smaller than the force 210A illustrated in FIG. 18A.

Figure 4:
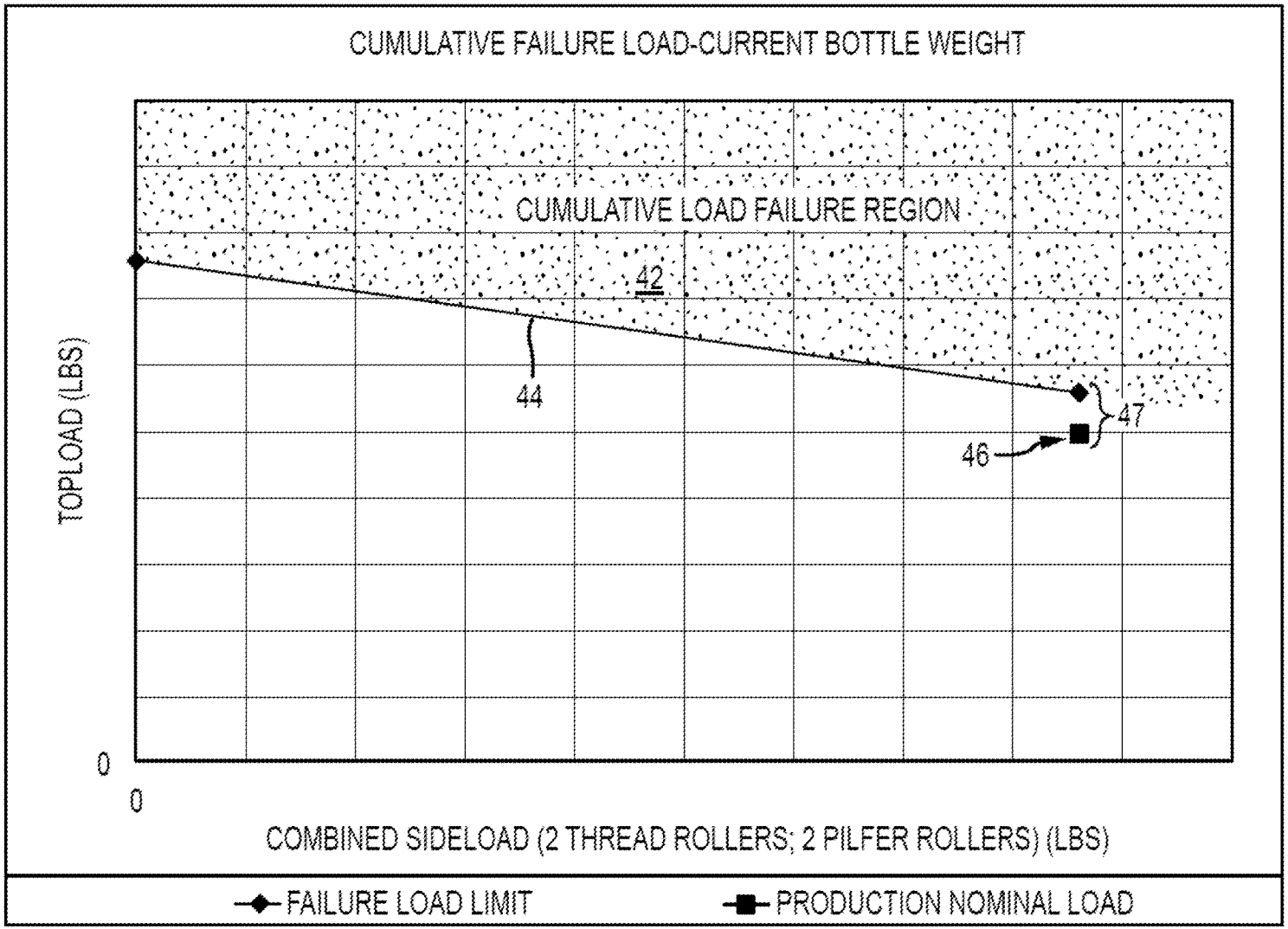
Fig. 4 (Prior Art)
FIG. 4 is a graph of the cumulative forces applied by a prior art capping apparatus to a metallic bottle during a capping process and illustrating a failure region in which the cumulative forces may be expected to cause failure of the metallic bottle or loss of seal between a ROPP closure and the metallic bottle.

Although a non-symmetrical thread shape such as generally illustrated in FIG. 18B is known to be used on some prior art plastic bottles, the side-load forces required to press a prior art metallic closure 10 against an overhung closure thread 130A would exceed the cumulative load when combined with other sideloads and the top-loads required to seal the metallic bottle and form a channel in the metallic closure. Accordingly, forming more overhung closure threads using on a prior art metallic closure using a prior art capping apparatus would be expected to exceed the failure threshold 44 and move into the cumulative load failure region 42 illustrated in FIG. 4. However, when a channel 70 is formed on a metallic closure 66 before the metallic closure 66 is position on the metallic bottle 116A, the capping apparatus 138 can form overhung closure threads 76A without exceeding the cumulative load of the metallic closure 66. Additionally, the threaded mandrel 104 of the thread forming apparatus 109 can be configured to form closure threads 76A with an overhung segment 81 as generally illustrated in FIG. 18B. Accordingly, in one embodiment, a metallic bottle 116A sealed with a metallic closure 66A of the present disclosure can store a product at a greater pressure than is possible with a prior art metallic bottle 2 and ROPP closure 10.

It is not possible to form this overhung thread geometry when the prior art closure threads 16 are created by a capping apparatus 22 for a prior art ROPP closure 10 positioned on a metallic bottle 2 because the top-load force applied to create the overhung thread geometry would typically cause failure of the metallic bottle 2. Forming overhung threads 16 with a prior art capping apparatus 22 leads to failure of metallic bottles 2 due to top-loads which exceed the column strength of the metallic bottles.

Referring again to FIG. 17, the closure threads 76 can optionally have a depth 77 that is greater than the depth of the threads 16 of the prior art ROPP closure 10. Optionally, in another embodiment, the bottle threads 130 can have a depth 131 that is greater than the depth of the prior art bottle threads 8. The increased depths 77, 131 of the closure threads 76 and bottle threads 130 of the present disclosure generate better engagement of the metallic closure 66 with a metallic bottle 116. Typically, the depth of closure threads is related to the amount of side-load applied by a thread roller or other tool used to form the closure threads. Accordingly, increasing the depth 77 of the closure threads 76 requires a greater side-load from the thread roller or tool 114. By forming the closure threads 76 while the threaded metallic closure 66 is positioned on a threaded mandrel 104, the side-load force of the thread roller 114 can be increased to form deeper threads. In contrast, if the deeper threads were formed by the prior art capping apparatus 22 with a ROPP closure 10 positioned on a prior art metallic bottle 2, the side-load generated by the thread roller 26 would be in the cumulative load failure region 42 of FIG. 4 and the metallic bottle 2 would fail.

The greater depths 77, 131 of the closure threads 76 and bottle threads 130 of the present disclosure also provide a predetermined amount of overlap 136 with threads 130 of a metallic bottle 116. As generally illustrated in FIG. 17, the thread overlap 136 is the distance between a valley 75 of a closure thread 76 and a peak 129 of a bottle thread 130. One of skill in the art will appreciate that metallic bottles 116 and threaded metallic closures 66 are manufactured to have diameters that fall within a predetermined range or specification. A bottle 116 can have a large diameter, or a small diameter, which is within the specified diameter. Similarly, a threaded metallic closure 66 can have a small diameter, or a large diameter, and be within specifications. By increasing the depth 77 of the closure threads 76 and the bottle thread depth 131, a threaded metallic closure 66 that has a large diameter, but which is within specification, can be used to seal a metallic bottle 116 which is within specification but with a small diameter. In this manner, the increased depths 77, 131 and corresponding increase in thread overlap 136 further reduce spoilage and waste for bottlers.

In contrast, there is no motivation to form deeper closure threads 16 on a prior art ROPP closure 10 as the closure threads 16 are custom fit to the bottle threads 8 as described above with FIG. 1C. Accordingly, variations in the diameter of the metallic bottle 2 are accounted for when the thread roller 26 forms the closure threads 16 while the ROPP closure 10 is on the metallic bottle 2. Additionally, increasing the depth of the closure threads 16 would generally cause a failure of the prior art metallic bottle 2 as more force is required to form deeper closure threads, such as the embodiment of the closure threads 76 illustrated in FIG. 17.

The closure threads 76 and the bottle threads 130 can optionally have depths 77, 131 of at least approximately 0.0235 inches. The depths 77, 131 can also be at least approximately 0.0240 inches. In one embodiment, the depths 77, 131 of the closure threads 76 and the bottle threads 130 are between approximately 0.0235 inches and approximately 0.040 inches. In one embodiment, the threads 76, 130 have depths 77, 131 sufficient to overlap 136 by at least approximately 0.023 inches. Optionally, the closure threads 76 can overlap 136 the bottle threads 130 by between approximately 0.020 inches and approximately 0.030 inches. In contrast, the radial overlap between an inside surface of a thread valley of a prior art metallic closure 10 and an outside surface of a peak of a bottle thread of a prior art metallic bottle 2 is typically about 0.019 inches.

A valley 133 (or minimum exterior diameter) of a bottle thread 130 has a predetermined clearance 137 from a valley 75 (or minimum interior diameter) of the closure threads 66. In one embodiment, the clearance 137 between a closure thread valley 75 and a bottle thread valley 133 is between approximately 0.010 inches and approximately 0.017 inches.

A metallic bottle 116 sealed with a metallic closure 66 by embodiments of the methods and apparatus described herein provides many benefits to consumers and manufacturers. A metallic bottle 116 of the present disclosure can store a product with a pressure of at least approximately 100 PSI before the product vents from the metallic bottle in a controlled release. A metallic closure 66 sealing a metallic bottle can withstand an internal pressure of up to at least 135 PSI before the metallic closure 66 loses thread engagement and is blown off of the metallic bottle 116. In one embodiment, the closure threads 76 and bottle threads 130 can have a geometry to withstand an internal pressure of approximately 175 PSI before loss of thread engagement and closure blow off occurs.

Additionally, a metallic bottle 116 sealed with a metallic closure 66 as described herein can be opened with less torque than prior art metallic bottles 2. More specifically, a threaded metallic closure 66 can be rotated in an opening direction with less than approximately 17 inch-pounds of torque. In another embodiment, the torque required to rotate the threaded metallic closure 66 in the opening direction is between approximately 13 and approximately 17 inch-pounds. As will be appreciated by one of skill in the art, decreasing the amount of torque required to open a sealed metallic bottle 116 means that more consumers will have sufficient strength to open the metallic bottle, including consumers with hand injuries or difficulty grasping and turning objects.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. An apparatus to form a channel around a perimeter of a closed end-wall of a metallic closure configured to seal a threaded neck of a metallic bottle, comprising:

an outer tool with a body and a cavity formed therein, the cavity including:

a first portion with a first interior sidewall that has a first interior diameter; and a second portion with a second interior sidewall that has a second interior diameter that is less than the first interior diameter; and an inner tool including:

a body portion that has a first outer diameter that is less than the first interior diameter and greater than the second interior diameter; and a projection extending from the body portion, the projection including:

a cylindrical sidewall with a second outer diameter that is less than the first outer diameter such that a first shoulder is formed between the body portion and the cylindrical sidewall; and an end-wall;

wherein the outer tool and the inner tool are configured to apply a force to the metallic closure to form the channel around the perimeter of the closed end-wall of the metallic closure when it is positioned there between.

2. The apparatus of claim 1, wherein the second interior diameter is greater than the second outer diameter such that the projection can extend into the second portion of the cavity.

3. The apparatus of claim 1, wherein the projection of the inner tool extends from the body portion by between approximately 0.080 inches and 0.140 inches.

4. The apparatus of claim 1, wherein the body portion can extend into the first portion of the cavity.

5. The apparatus of claim 1, wherein the outer tool is interconnected to an outer tool retainer, and wherein the inner tool is movable relative to an inner tool retainer.

6. The apparatus of claim 5, further comprising:

a first spacer, wherein the outer tool retainer is interconnected to the first spacer; and a second spacer, wherein the inner tool retainer is interconnected to the second spacer, wherein the inner tool includes a flange configured to engage the inner tool retainer, the flange being integrally formed with the inner tool and extending from a rearward end of the body portion, wherein the flange has a third outer diameter that is greater than the first outer diameter of the body portion, and wherein a biasing element is positioned between the inner tool and the second spacer.

7. The apparatus of claim 5, wherein the outer tool is stationary with respect to the outer tool retainer.

8. The apparatus of claim 1, wherein the outer tool includes a second shoulder positioned between the first and second interior sidewalls, the second shoulder being oriented approximately parallel to the first shoulder.

9. The apparatus of claim 8, wherein the first shoulder is approximately perpendicular to the body portion and to the cylindrical sidewall, and wherein the second shoulder is approximately perpendicular to the first and second interior sidewalls.

10. The apparatus of claim 1, wherein the inner tool further comprises:

a chamber in the body portion;

an aperture extending through the end-wall of the projection to the chamber, wherein the chamber and the aperture are concentrically aligned;

a bearing retained in the chamber that is extendable through the aperture; and a biasing element that extends into the chamber to engage the bearing.

11. The apparatus of claim 10, wherein the chamber extends to a rearward end of the body portion that is opposite to the projection and includes a first chamber portion with a first inner diameter that is greater than a second inner diameter of a second chamber portion.

12. The apparatus of claim 11, wherein a third shoulder is formed between the first chamber portion and the second chamber portion, wherein a biasing element extends into the first chamber portion to engage the third shoulder, and wherein the aperture has a third inner diameter that is less than the second inner diameter such that a fourth shoulder is formed within the second chamber portion.

13. The apparatus of claim 1, wherein the second outer diameter of the projection is constant between the first shoulder and the end-wall of the projection.

14. The apparatus of claim 1, wherein the inner tool further comprises:

a first radius of curvature between the end-wall and the cylindrical sidewall of the projection;

a second radius of curvature between the cylindrical sidewall and the first shoulder; and a third radius of curvature between the first shoulder and the body portion.

15. The apparatus of claim 1, wherein the first interior diameter of the outer tool is constant.

16. The apparatus of claim 1, wherein the first interior sidewall of the outer tool is oriented parallel to the body portion of the inner tool, and wherein the cylindrical sidewall of the projection is oriented parallel to the body portion of the inner tool.

17. A method of forming a metallic closure configured to seal a threaded neck of a metallic bottle, comprising:

aligning the metallic closure with an outer tool and an inner tool of a channel forming apparatus, the outer tool and the inner tool being configured to apply a force to the metallic closure to form a channel around an outer perimeter edge of a closed end-wall of the metallic closure when it is positioned there between, wherein:

the outer tool has a body and a cavity formed therein, the cavity including:

a first portion with a first interior sidewall that has a first interior diameter; and a second portion with a second interior sidewall that has a second interior diameter that is less than the first interior diameter; and the inner tool including:

a body portion that has a first outer diameter that is less than the first interior diameter and greater than the second interior diameter; and a projection extending from the body portion, the projection including:

a cylindrical sidewall with a second outer diameter that is less than the first outer diameter such that a first shoulder is formed between the body portion and the cylindrical sidewall; and an end-wall; and moving at least one of the inner tool, the outer tool, and the metallic closure to form the channel in an outer perimeter edge of the metallic closure, the channel positioned between a cylindrical body and the closed end-wall of the metallic closure.

18. An apparatus to form a channel around a perimeter of a closed end-wall of a metallic closure which is configured to seal a threaded neck of a bottle, comprising:

an outer tool with a body and a cavity formed therein, the outer tool being interconnected to an outer tool retainer, the cavity including:

a first portion with a first interior diameter; and a second portion with a second interior diameter that is less than the first interior diameter; and an inner tool moveably interconnected to an inner tool retainer and including:

a body portion that has a first outer diameter that is less than the first interior diameter such that the body portion can extend into the first portion of the cavity; and a projection extending from the body portion, the projection including:

a cylindrical sidewall with a second outer diameter that is less than the first outer diameter such that a first shoulder is formed between the body portion and the cylindrical sidewall; and an end-wall;

wherein the outer tool and the inner tool are configured to apply a force to the metallic closure to form the channel around the perimeter of the closed end-wall of the metallic closure when it is positioned there between.

19. The apparatus of claim 18, wherein the outer tool is stationary with respect to the outer tool retainer.

20. The apparatus of claim 18, wherein the first shoulder is approximately perpendicular to the body portion and to the cylindrical sidewall, and wherein the outer tool includes a second shoulder positioned between a first interior sidewall of the first portion of the cavity and a second interior sidewall of the second portion of the cavity, the second shoulder being approximately perpendicular to the first and second interior sidewalls and oriented parallel to the first shoulder.

* * * * *